US012372252B2

(12) United States Patent
Garg et al.

(10) Patent No.: US 12,372,252 B2
(45) Date of Patent: Jul. 29, 2025

(54) BAFFLE ASSEMBLY FOR AN OVEN TO GENERATE DISTINCT AIR FLOW REGIONS WITHIN A COOKING CHAMBER HAVING A DIFFERENT TEMPERATURE

(71) Applicant: WHIRLPOOL CORPORATION, Benton Harbor, MI (US)

(72) Inventors: Ankur Garg, Pune (IN); Harishkumar, Kalaburagi (IN); Raakesh Pankanti, Hyderabad (IN); Satyabrata Dalai, Khurda (IN); Dhanaji Haridas Bhosale, Solapur (IN)

(73) Assignee: Whirlpool Corporation, Benton Harbor, MI (US)

( * ) Notice: Subject to any disclaimer, the term of this patent is extended or adjusted under 35 U.S.C. 154(b) by 684 days.

(21) Appl. No.: 17/669,238

(22) Filed: Feb. 10, 2022

(65) Prior Publication Data

US 2023/0250970 A1 Aug. 10, 2023

(51) Int. Cl.
*F24C 15/32* (2006.01)

(52) U.S. Cl.
CPC ..... *F24C 15/325* (2013.01)

(58) Field of Classification Search
None
See application file for complete search history.

(56) References Cited

U.S. PATENT DOCUMENTS 7,087,863 B1 8/2006 Kim et al.
7,183,520 B2 * 2/2007 Park ..... H05B 6/642 219/394
7,784,457 B2 * 8/2010 Akdag ..... F24C 15/322 126/21 R
8,878,106 B2 11/2014 Hensel et al.
9,420,800 B1 8/2016 Froelicher et al.
10,203,117 B2 2/2019 Moon et al.
10,398,260 B2 9/2019 Park et al.
10,548,327 B2 2/2020 Hamon et al.
10,684,022 B2 6/2020 McKee et al.
10,688,496 B2 * 6/2020 Demirkaya ..... B01L 7/00
10,729,144 B2 8/2020 McKee et al.
10,837,651 B2 11/2020 Bruin-Slot et al.
(Continued)

FOREIGN PATENT DOCUMENTS

DE 0580940 A2 * 2/1994 ..... F24C 15/325
DE 102007039379 B4 10/2012
(Continued)

*Primary Examiner* — Michael G Hoang
*Assistant Examiner* — Elizabeth Ann Laughlin
(74) *Attorney, Agent, or Firm* — Price Heneveld LLP

(57) ABSTRACT

An oven including a baffle assembly including: (i) a top inlet positioned to draw air from the cooking chamber, (ii) a pair of top outlets, positioned laterally away from the top inlet, one top outlet positioned at each of two sides of the baffle assembly to return air to the cooking chamber, (iii) top air flow paths from the top inlet to the pair of top outlets, (iv) a bottom inlet positioned to draw air from the cooking chamber, (v) a pair of bottom outlets, positioned laterally away from the bottom inlet, one bottom outlet at each of the two sides of the baffle assembly to return air to the cooking chamber, and (vi) bottom air flow paths from the bottom inlet to the pair of bottom outlets.

20 Claims, 19 Drawing Sheets

(56) References Cited

U.S. PATENT DOCUMENTS

| | | | | |
|---|---|---|---|---|
| 2006/0137675 | A1* | 6/2006 | Kim | F24C 15/325 126/21 A |
| 2009/0090347 | A1* | 4/2009 | Kim | F24C 15/325 426/523 |
| 2010/0006085 | A1* | 1/2010 | Thomas | F24C 15/325 165/104.34 |
| 2010/0012644 | A1* | 1/2010 | Phillips | F24C 15/325 219/400 |
| 2010/0147825 | A1* | 6/2010 | Bonuso | F24C 15/325 219/400 |
| 2012/0180775 | A1 | 7/2012 | Waltz et al. | |
| 2013/0284161 | A1* | 10/2013 | Johnson | F24C 15/325 126/21 A |
| 2016/0356504 | A1 | 12/2016 | McKee et al. | |
| 2021/0108803 | A1 | 4/2021 | Johnson et al. | |

FOREIGN PATENT DOCUMENTS

| | | | | |
|---|---|---|---|---|
| EP | 0580940 | A2 | 2/1994 | |
| EP | 3546832 | B1 | 4/2021 | |
| EP | 3252381 | B1 | 8/2021 | |
| KR | 1020050079522 | A | 8/2005 | |
| KR | 100790391 | B1 | 1/2008 | |
| WO | WO-2007125123 | A1 * | 11/2007 | F24C 15/16 |
| WO | 2020108917 | A1 | 6/2020 | |

* cited by examiner

BAFFLE ASSEMBLY FOR AN OVEN TO GENERATE DISTINCT AIR FLOW REGIONS WITHIN A COOKING CHAMBER HAVING A DIFFERENT TEMPERATURE

BACKGROUND

The present disclosure generally relates to an oven, and more specifically, to a baffle assembly for the oven that creates distinct air flow regions within a cooking chamber of the oven having different temperatures.

A user sometimes utilizes an oven to cook a food item or more than one food items for a meal. However, there are several problems. First, an oven preheats an entire volume of a cooking chamber regardless of a percentage of the volume the food item to be heated in the cooking chamber occupies. So preheating the oven results in an inefficient use of energy and time when the volume of the food item to be heated in the cooking chamber is relatively small compared to the volume of the cooking chamber that is preheated.

Second, the user cannot typically cook more than one food item simultaneously, because each food item typically requires a different temperature at which to be cooked. Rather, the user must typically cook a first food item in the oven at a first temperature, remove the first food item, wait for the cooking chamber to settle at a second temperature at which the second food item is to be cooked, and then cook the second food item at that second temperature. This problem again results in an inefficient use of energy and time because the food items have to be cooked consecutively rather than simultaneously.

SUMMARY OF THE DISCLOSURE

According to one aspect of the present disclosure, an oven comprises: (a) interior walls forming a cooking chamber and providing an opening into the cooking chamber; (b) a baffle assembly comprising: (i) a top inlet positioned to draw air from the cooking chamber, (ii) a pair of top outlets, positioned laterally away from the top inlet, with one of the pair of top outlets positioned on one side of the baffle assembly and the other of the pair of top outlets positioned on another side of the baffle assembly, the pair of top outlets positioned to return air to the cooking chamber, (iii) top air flow paths from the top inlet to the pair of top outlets, (iv) a top wall that defines a top of each of the pair of top outlets and a top surface of the top air flow paths, (v) a bottom inlet positioned to draw air from the cooking chamber, (vi) a pair of bottom outlets, positioned laterally away from the bottom inlet, with one of the pair of bottom outlets positioned on the one side of the baffle assembly and the other of the pair of top outlets positioned on the other side of the baffle assembly, the pair of bottom outlets positioned to return air to the cooking chamber, (vii) bottom air flow paths from the bottom inlet to the pair of bottom outlets, and (viii) a bottom wall that defines a bottom of each of the pair of bottom outlets and a bottom surface of the bottom air flow paths; (c) a top fan positioned to force air to flow from the cooking chamber, through the top inlet, through the top air flow paths, and then back into the cooking chamber; (d) a top heating element positioned to heat air flowing through the top air flow paths; (e) a bottom fan positioned to force air to flow from the cooking chamber, through the bottom inlet, through the bottom air flow paths, and then back into the cooking chamber; and (f) a bottom heating element positioned to heat air flowing through the bottom air flow paths.

In embodiments, the oven further comprises: a door that is movable to, from, and between (i) a closed position where the door covers the opening into the cooking chamber and (ii) an open position where the door allows access through the opening into the cooking chamber from an external environment.

In embodiments, the top inlet and the pair of top outlets are elevated higher than the bottom inlet and the pair of bottom outlets. In embodiments, the top wall of the baffle assembly is planar. In embodiments, the bottom wall of the baffle assembly is planar. In embodiments, a top of the top outlet at the one side and a bottom of the bottom outlet at the one side are parallel. In embodiments, a top of the top outlet at the other side and a bottom of the bottom outlet at the other side are parallel.

In embodiments, the baffle assembly further comprises a first lateral vertical wall at the one side of the baffle assembly that defines a bottom of the top outlet and a top of the bottom outlet disposed at the one side of the baffle assembly. In embodiments, the first lateral vertical wall separates the bottom of the top outlet from the top of the bottom outlet at the one side of the baffle assembly. In embodiments, the baffle assembly further comprises a second lateral vertical wall at the other side of the baffle assembly that defines a bottom of the top outlet and a top of the bottom outlet disposed at the other side of the baffle assembly. In embodiments, the second lateral vertical wall separates the bottom of the top outlet from the top of the bottom outlet at the other side of the baffle assembly.

In embodiments, the baffle assembly further comprises a pair of middle outlets, one of the pair of middle outlets disposed at the one side of the baffle assembly between the top outlet and the bottom outlet that are disposed at the one side of the baffle assembly, and the other of the pair of middle outlets disposed at the other side of the baffle assembly between the top outlet and the bottom outlet that are disposed at the other side of the baffle assembly. In embodiments, the baffle assembly further comprises a first door and a second door. In embodiments, the first door is positioned relative to the middle outlet disposed at the one side of the baffle assembly so that, in a closed position, the first door closes the middle outlet, and, in an open position, air can flow from both the top air flow path and the bottom air flow path through the middle outlet disposed at the one side of the baffle assembly. In embodiments, the second door is positioned relative to the middle outlet disposed at the other side of the baffle assembly so that, in a closed position, the second door closes the middle outlet, and, in an open position, air can flow from both the top air flow path and the bottom air flow path through the middle outlet disposed at the other side of the baffle assembly. In embodiments, both the first door and the second door are in their respective closed position when a user cooks two food items, each of the two food items at a different temperature, the food item cooked at the higher temperature disposed elevationally above the food item cooked at the lower temperature.

In embodiments, the baffle assembly further comprises a middle wall disposed between the top wall and the bottom wall, the middle wall defining (i) a bottom surface of the top air flow paths and (ii) a top surface of the bottom air flow paths. In embodiments, the bottom surface of the top air flow paths and the top surface of the bottom air flow paths are generally horizontal. In embodiments, the top fan spins in a direction that is opposite of a direction in which the bottom fan spins. In embodiments, the oven further comprises a top region and a bottom region of air flow within the cooking chamber, the top region disposed elevationally above the bottom region. In embodiments, the top region of air flow has a temperature that is at least 20° C. greater than a temperature of the bottom region of air flow.

In embodiments, interior walls defining the cooking chamber comprise a top wall and a bottom wall, the top wall and the bottom wall being separated by an average vertical distance. In embodiments, air flow within the cooking chamber at a top horizontal plane that is disposed above a midpoint of the average vertical distance comprises a temperature that is at least 20° C. greater than a temperature of air flow within the cooking chamber at a bottom horizontal plane that is disposed below the midpoint of the average vertical distance. In embodiments, the cooking chamber is free of a solid matter barrier physically dividing the cooking chamber between the top wall and the bottom wall.

In embodiments, the interior walls forming the cooking chamber comprise a rear wall that is rearward of the opening into the cooking chamber. In embodiments, the baffle assembly further comprises a forward wall that is forward of the rear wall of the interior walls forming the cooking chamber. In embodiments, the top inlet and the bottom inlet are disposed through the forward wall of the baffle assembly. In embodiments, the forward wall of the baffle assembly defines (i) a forward portion of each of the pair of top outlets, (ii) a forward surface of the top air flow path, (iii) a forward portion of each of the pair of bottom outlets, and (iv) a forward surface of the bottom air flow path. In embodiments, the top surface of the top air flow path that the top wall of the baffle assembly defines is generally horizontal. In embodiments, the bottom surface of the bottom air flow path that the bottom wall of the baffle assembly defines is generally horizontal. In embodiments, the forward surfaces of the top air flow path and the bottom air flow path that the forward wall define are generally vertical. In embodiments, the middle wall of the baffle assembly defines (i) a bottom surface of the top air flow paths and (ii) a top surface of the bottom air flow paths. In embodiments, the bottom surface of the top air flow paths and the top surface of the bottom air flow paths are generally horizontal. In embodiments, the top fan, the bottom fan, the top heating element, and the bottom heating element are all disposed rearward of the forward wall of the baffle assembly.

According to another aspect of the present disclosure, an oven comprises: (I) interior walls forming a cooking chamber and providing an opening into the cooking chamber, the interior walls comprising a rear wall that is disposed rearward of the opening; (II) a baffle assembly attached to the rear wall of the interior walls forming the cooking chamber and projecting forward from the rear wall toward the opening, the baffle assembly comprising: (a) a perimeter flange that is generally planar and vertically sets flush against the rear wall that partially forms the cooking chamber; (b) a top wall that is generally planar and disposed horizontally; (c) a bottom wall that is generally planar and disposed horizontally; (d) a middle wall disposed between the top wall and the bottom wall that is generally planar and disposed horizontally; (e) a forward wall that (i) is generally planar and disposed vertically, (ii) is disposed forward of the top wall, the bottom wall, and the middle wall, (iii) coincides with the top wall, the bottom wall, and the middle wall, (iv) comprises a top inlet into the baffle assembly disposed elevationally above the middle wall, and (v) comprises a bottom inlet into the baffle assembly disposed elevationally below the middle wall; (f) a forward wall that (i) is generally planar and disposed vertically, (ii) is disposed forward of the top wall, the bottom wall, and the middle wall, (iii) coincides with the top wall, the bottom wall, and the middle wall, (iv) comprises a top inlet into the baffle assembly disposed elevationally above the middle wall, and (v) comprises a bottom inlet into the baffle assembly disposed elevationally below the middle wall; (g) a first lateral vertical wall that is generally planar, disposed vertically, disposed forward of the perimeter flange and rearward of the forward wall, the first lateral vertical wall comprising (i) a rear that coincides with the perimeter flange, (ii) a top that coincides with the top wall, (iii) a bottom that coincides with the bottom wall, and (iv) a front that does not coincide with the forward wall except at a top tab and a bottom tab disposed between the top and the bottom that extend forward to coincide with the forward wall, the top tab being disposed elevationally higher than the middle wall, and the bottom tab being disposed elevationally lower than the middle wall; and (h) a second lateral vertical wall opposing the first lateral vertical wall that is generally planar, disposed vertically, disposed forward of the perimeter flange and rearward of the forward wall, the second lateral vertical wall comprising (i) a rear that coincides with the perimeter flange, (ii) a top that coincides with the top wall, (iii) a bottom that coincides with the bottom wall, and (iv) a front that does not coincide with the forward wall except at a top tab and a bottom tab disposed between the top and the bottom that extend forward to coincide with the forward wall, the top tab being disposed elevationally higher than the middle wall, and the bottom tab being disposed elevationally lower than the middle wall.

In embodiments, the top wall, the forward wall, and the first lateral vertical wall cooperate to form a top outlet that is disposed elevationally above the middle wall, with the top wall forming a top of the top outlet, the forward wall forming a forward portion of the top outlet, the first lateral vertical wall forming a rear portion of the top outlet, and the top tab of the first lateral vertical wall forming a bottom of the top outlet.

In embodiments, the forward wall and the first lateral vertical wall cooperate to form a middle outlet that is disposed to overlap elevationally with the middle wall, with the top tab of the first lateral vertical wall forming a top of the middle outlet, the forward wall forming a forward portion of the middle outlet, the first lateral vertical wall forming a rear portion of the middle outlet, and the bottom tab of the first lateral vertical wall forming a bottom of the middle outlet.

In embodiments, the bottom wall, the forward wall, and the first lateral vertical wall cooperate to form a bottom outlet that is disposed elevationally below the middle wall, with the bottom wall forming a bottom of the bottom outlet, the forward wall forming a forward portion of the bottom outlet, the first lateral vertical wall forming a rear portion of the bottom outlet, and the bottom tab of the first lateral vertical wall forming a top of the bottom outlet.

In embodiments, the top wall, the forward wall, and the second lateral vertical wall cooperate to form a top outlet that is disposed elevationally above the middle wall, with the top wall forming a top of the top outlet, the forward wall forming a forward portion of the top outlet, the second lateral vertical wall forming a rear portion of the top outlet, and the top tab of the second lateral vertical wall forming a bottom of the top outlet.

In embodiments, the forward wall and the second lateral vertical wall cooperate to form a middle outlet that is disposed to overlap elevationally with the middle wall, wherein the top tab of the second lateral vertical wall forms a top of the middle outlet, the forward wall forms a forward portion of the middle outlet, the second lateral vertical wall forms a rear portion of the middle outlet, and the bottom tab of the second lateral vertical wall forms a bottom of the middle outlet.

In embodiments, the top wall, the forward wall, and the second lateral vertical wall cooperate to form a bottom outlet that is disposed elevationally below the middle wall, with the bottom wall forming a bottom of the bottom outlet, the forward wall forming a forward portion of the bottom outlet, the second lateral vertical wall forming a rear portion of the bottom outlet, and the second tab of the second lateral vertical wall forming a top of the bottom outlet.

In embodiments, the top wall, the forward wall, the first lateral vertical wall, the second lateral vertical wall, and the middle wall cooperate to form top air flow paths for air to flow from the cooking chamber, through the top inlet, rearward of the forward wall, out the top outlets at the first lateral vertical wall and the second lateral vertical wall, and back into the cooking chamber.

In embodiments, the bottom wall, the forward wall, the first lateral vertical wall, the second lateral vertical wall, and the middle wall cooperate to form bottom air flow paths for air to flow from the cooking chamber, through the bottom inlet, rearward of the forward wall, out the bottom outlets at the first lateral vertical wall and the second lateral vertical wall, and back into the cooking chamber.

In embodiments, the baffle assembly further comprises: (a) a first door comprising (i) a closed position that closes the middle outlet disposed at the first lateral vertical wall and (ii) an open position that allows access through the middle outlet disposed at the first lateral vertical wall; and (b) a second door comprising (i) a closed position that closes the middle outlet disposed at the second lateral vertical wall and (ii) an open position that allows access through the middle outlet disposed at the second lateral vertical wall.

These and other features, advantages, and objects of the present disclosure will be further understood and appreciated by those skilled in the art by reference to the following specification, claims, and appended drawings.

Figure 1:
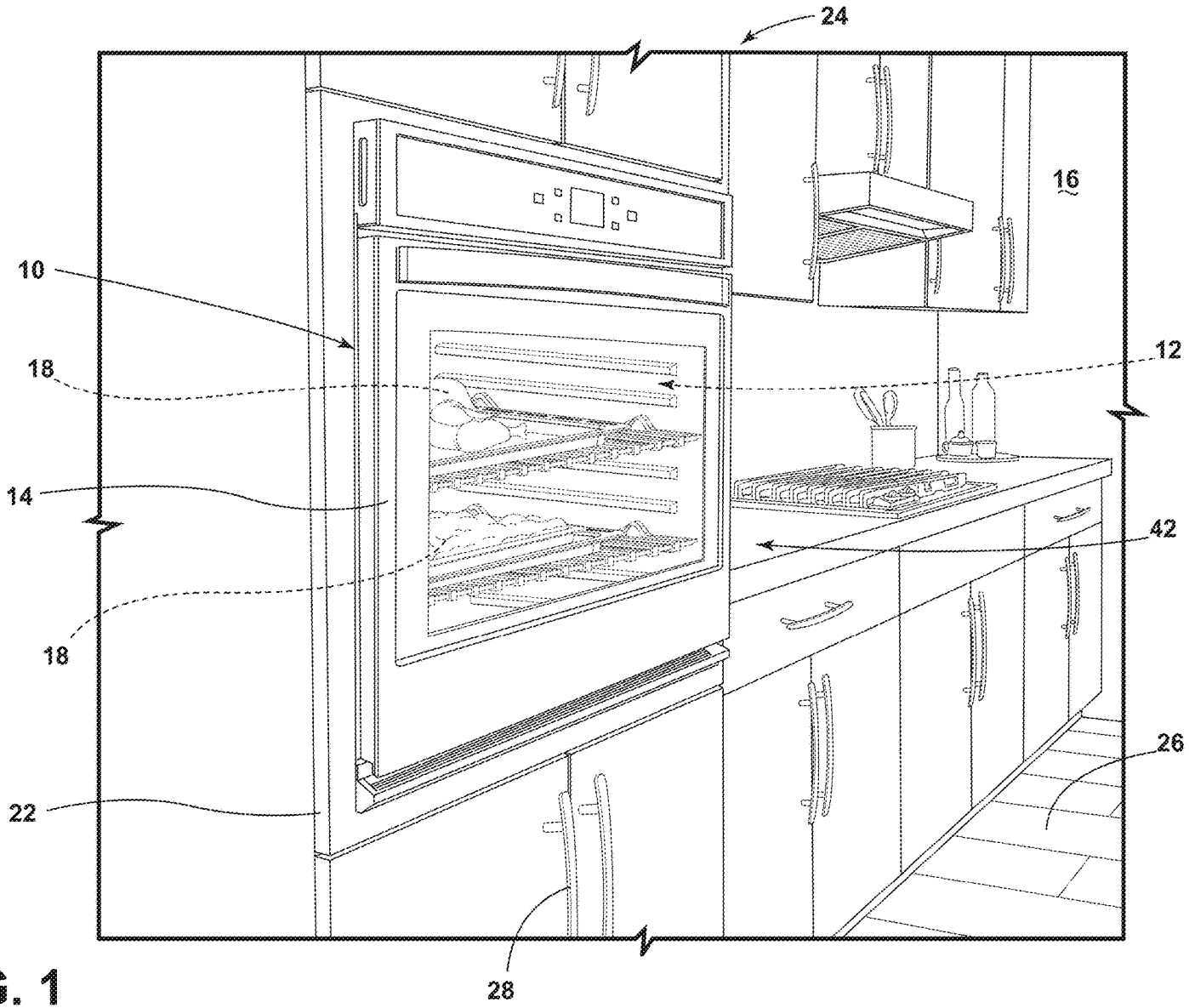
FIG. 1 is a perspective view of an oven of the present disclosure with two food items being cooked within a cooking chamber.

The components in the figures are not necessarily to scale, emphasis instead being placed upon illustrating the principles described herein.

DETAILED DESCRIPTION

The present illustrated embodiments reside primarily in combinations of method steps and apparatus components related to an oven with a baffle assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprise the element.

Referring to FIGS. 1-5, an oven 10 includes a cooking chamber 12 and a door 14 providing selective access to the cooking chamber 12 from an external environment 16. The oven 10 is configured to cook one or more food items 18 that are disposed within the cooking chamber 12. The oven 10 may be considered to be a "wall oven," as illustrated at FIG. 1, where a cabinet 20 of the oven 10 is mostly hidden behind paneling 22 or other structural features of a kitchen 24 or other room where the oven 10 is disposed. The oven 10 may be elevated in such instances from a floor 26 of the kitchen 24 or other room where the oven 10 is disposed. In other embodiments, the oven 10 is part of a "range" unit and further includes a cooktop (not illustrated) disposed above the cooking chamber 12. In such embodiments, the oven 10 (*i*) may be of the "slide-in" variety where cabinetry 28, the paneling 22, or other structural features within the kitchen 24 (or other room) generally hide the cabinet 20 of the oven 10, or (ii) may be of the "freestanding" variety where cabinetry 28, paneling 22, or other structural features of the kitchen 24 (or other room) do not hide the cabinet 20 of the oven 10 but, rather, a covering (not illustrated) covers the cabinet 20 of the oven 10.

The oven 10 further includes interior walls 30*a*, 30*b*, 30*c*, . . . 30*n* that form the cooking chamber 12 and provide an opening 32 into the cooking chamber 12. In embodiments, as illustrated, the interior walls 30*a*, 30*b*, 30*c*, . . . 30*n* include a rear wall 30*a* that is rearward of the opening 32 into the cooking chamber 12. In addition, in embodiments, the interior walls 30*a*, 30*b*, 30*c*, . . . 30*n* include top wall 30*b*, a bottom wall 30*c* that opposes the top wall 30*b*, and two opposing lateral walls 30*d*, 30*e*. The top wall 30*b* and the bottom wall 30*c* can be disposed generally horizontally, while the rear wall 30*a* and the lateral walls 30*d*, 30*e* can be disposed generally vertically. An average vertical distance 34 (see FIG. 3) separates the top wall 30*b* and bottom wall 30*c*. The average vertical distance 34 can be determined by measuring the vertical distance between the top wall 30*b* and the bottom wall 30*c* at five spatially separated places and then averaging the distances. The average vertical distance 34 has a midpoint 36.

In embodiments, the oven 10 includes a series of horizontal ridges 38 disposed at the two opposing lateral walls 30*d*, 30*e*. The horizontal ridges 38 extend into the cooking chamber 12. The horizontal ridges 38 at one of the two opposing lateral walls 30*d*, 30*e* are horizontally aligned with the horizontal ridges 38 at the other of the two opposing lateral walls 30*d*, 30*e*. The horizontal ridges 38 cooperate to support one or more racks 40 at a desired position within the cooking chamber 12.

Figure 2:
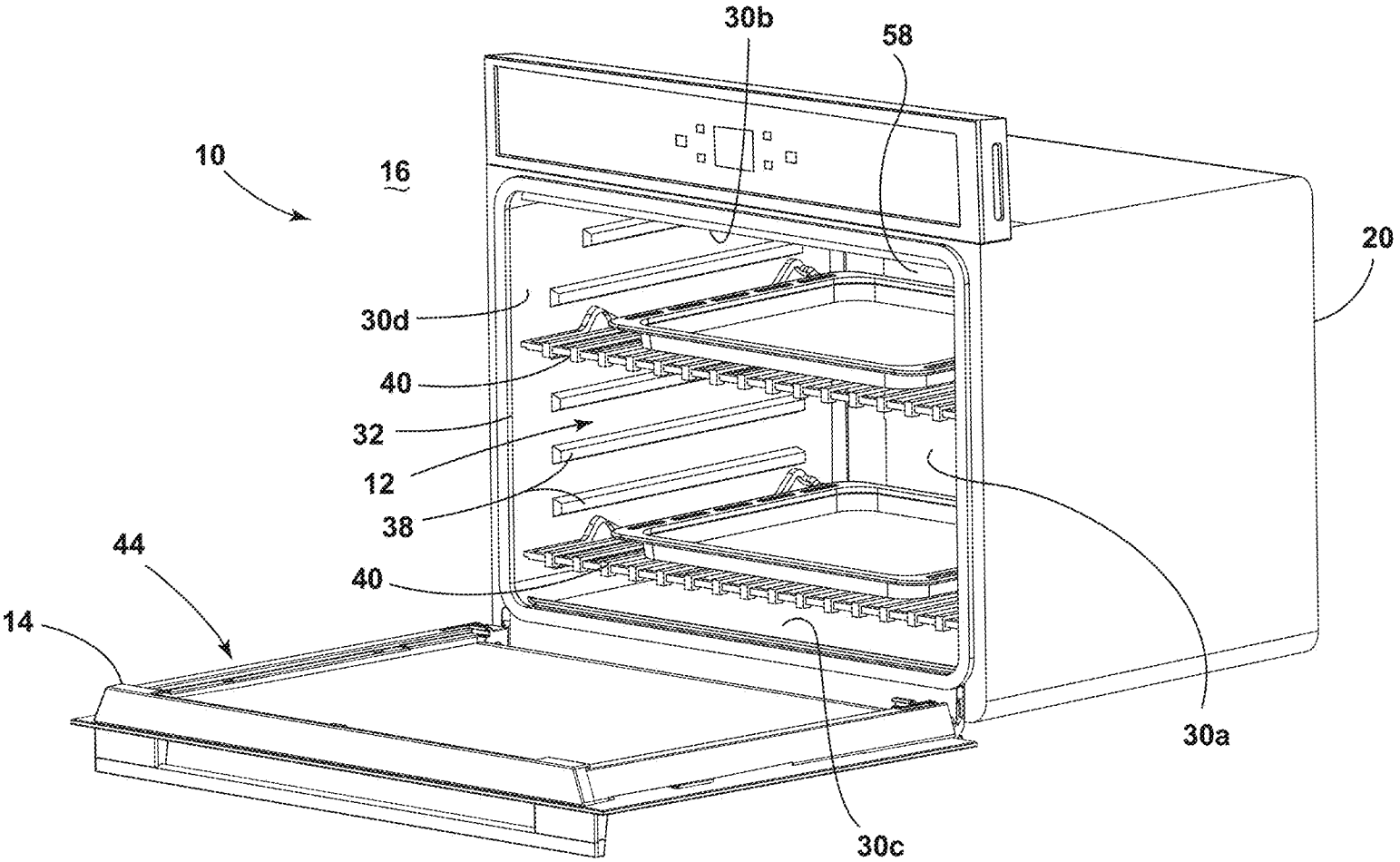
FIG. 2 is a perspective view of the oven of FIG. 1, illustrating interior walls, including a top wall, a bottom wall, and a rear wall in part forming the cooking chamber.
Figure 3:
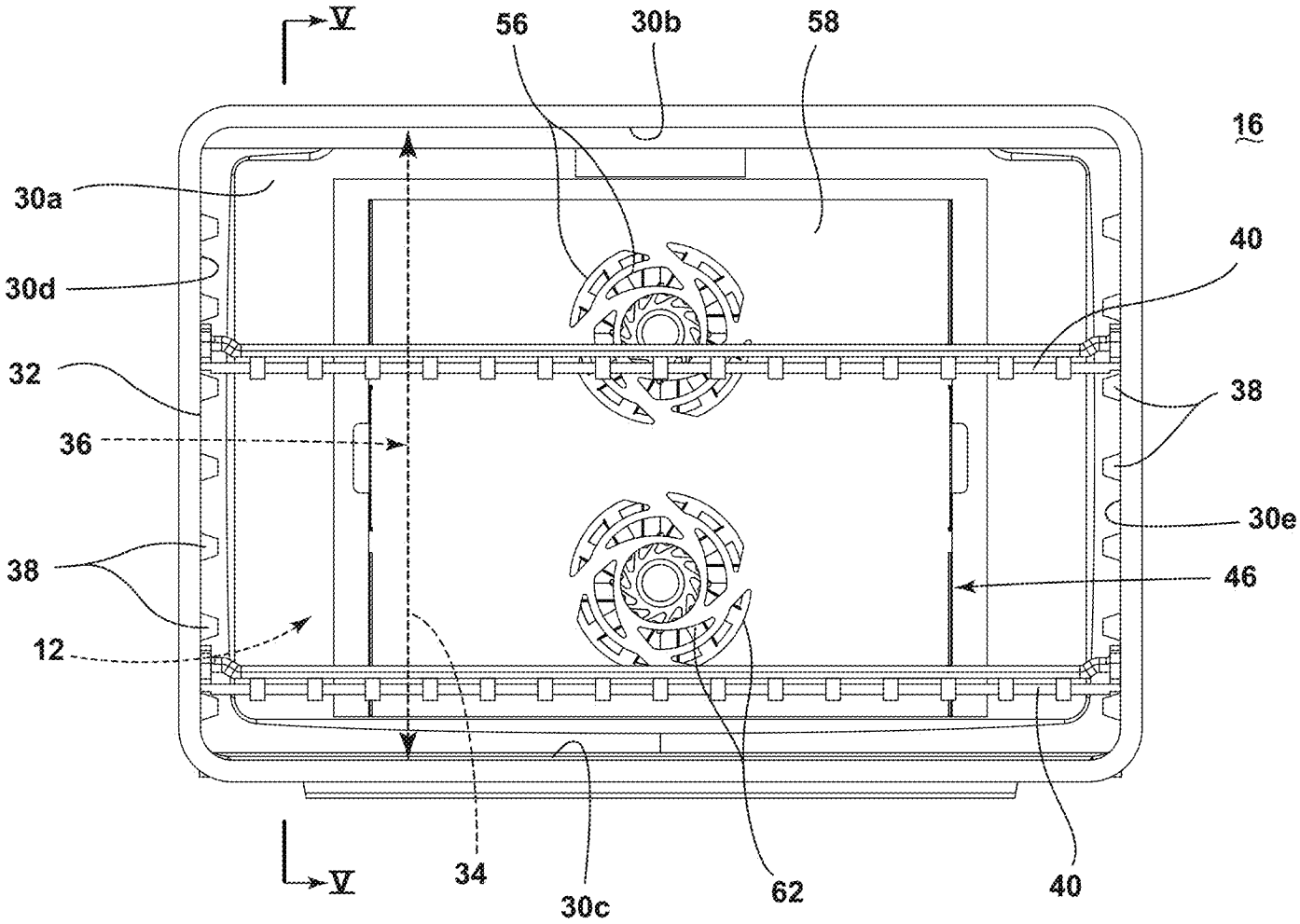
FIG. 3 is an elevational view of the cooking chamber illustrating the oven further including a baffle assembly disposed on the rear wall of the cooking chamber.
Figure 4:
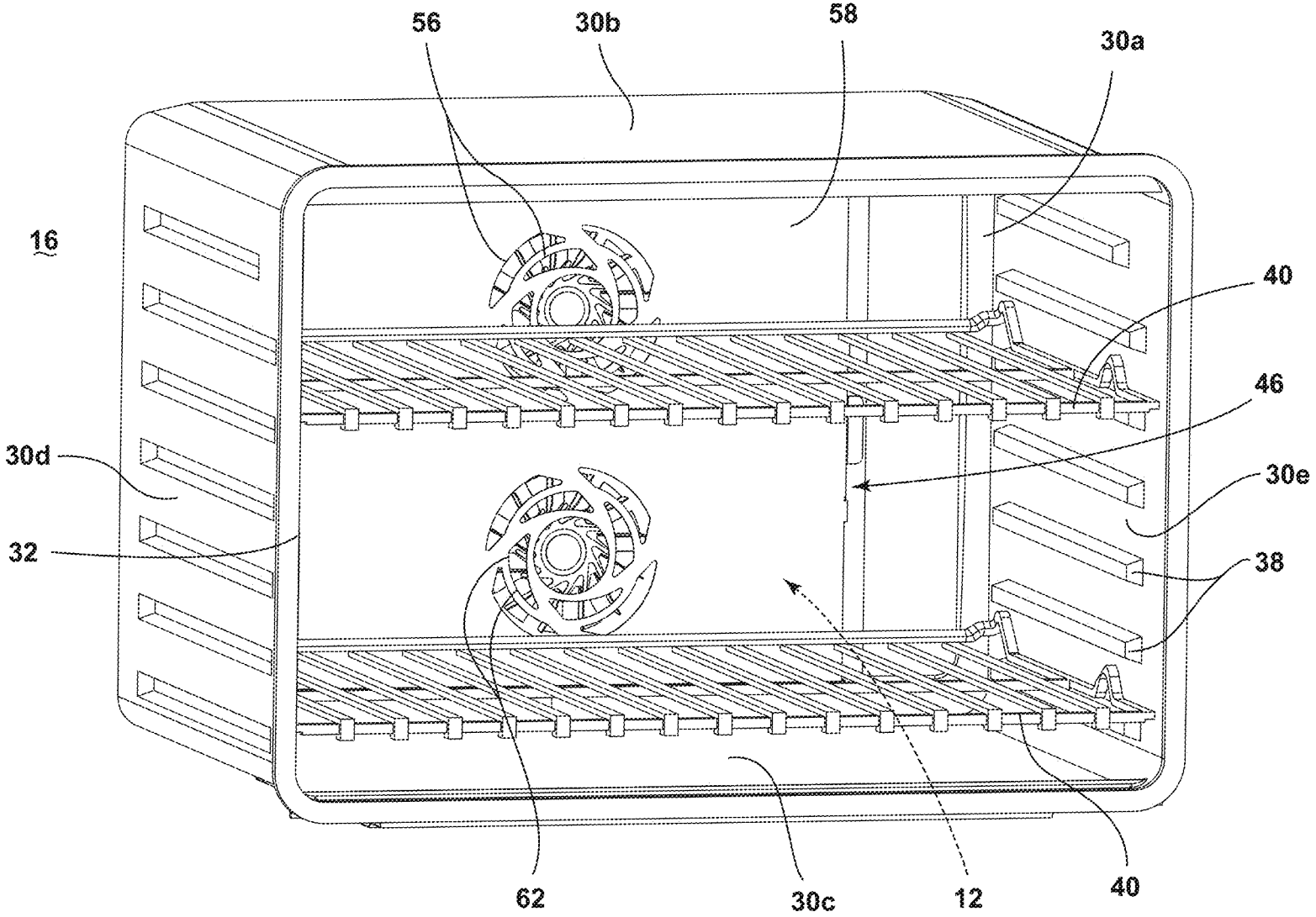
FIG. 4 is a perspective view of the cooking chamber, illustrating the baffle assembly including a top inlet and a bottom inlet to draw air from the cooking chamber into the baffle assembly for heating and discharge back into the cooking chamber.
Figure 5:
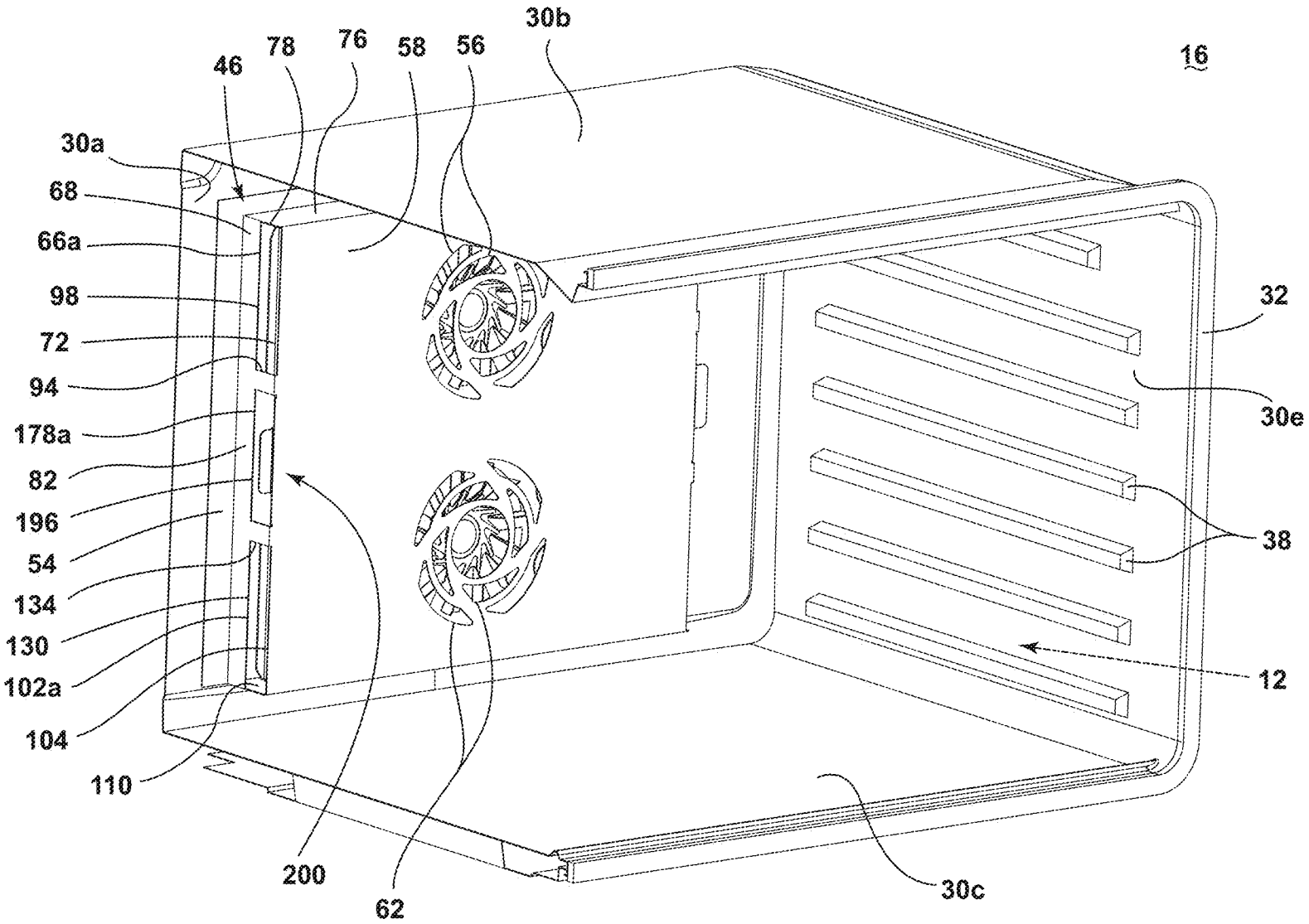
FIG. 5 is perspective view of a cross-section of the cooking chamber taken through line V-V of FIG. 3, illustrating the baffle assembly further including a top outlet for the air drawn into the top inlet, and a bottom outlet for the air drawn into the bottom inlet.
Figure 6:
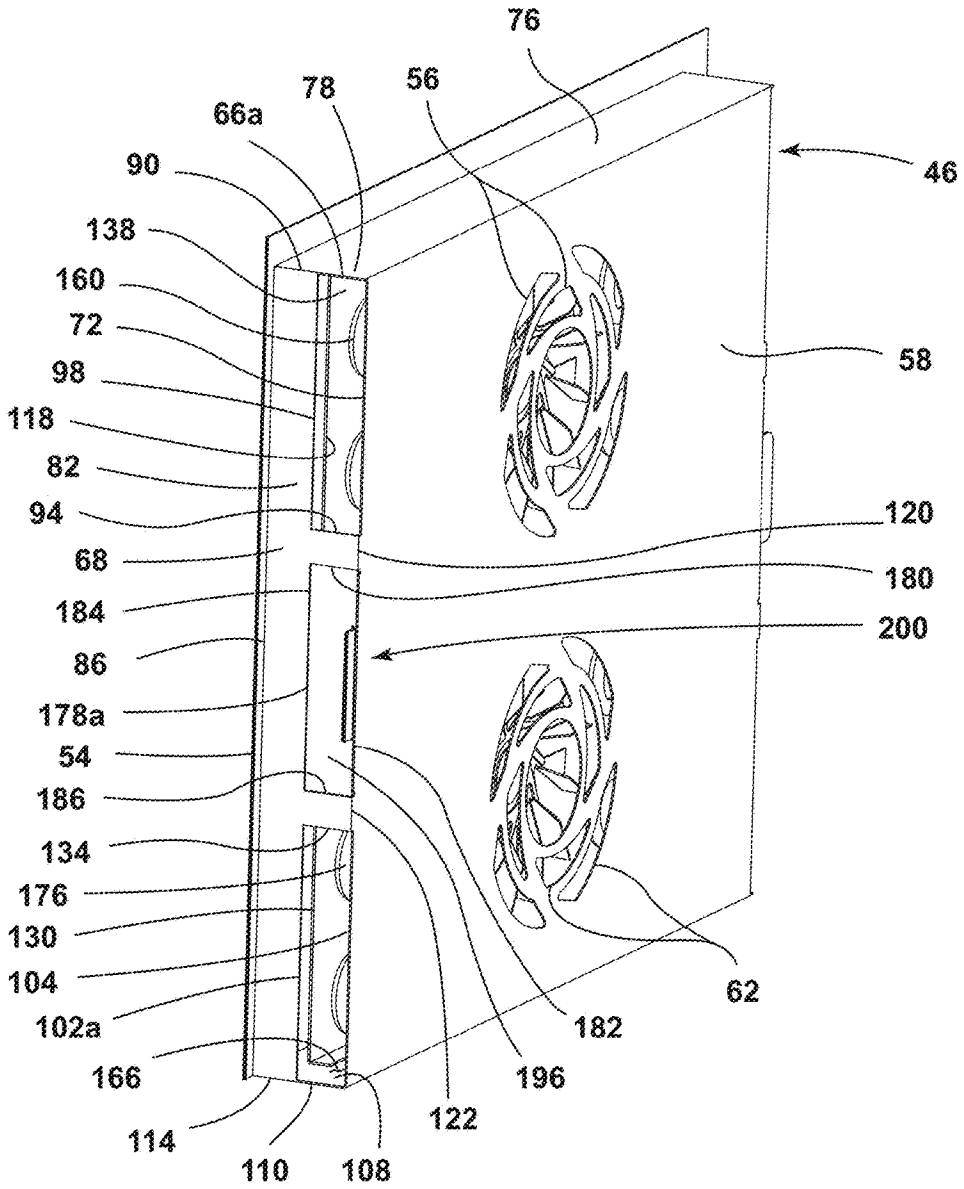
FIG. 6 is a perspective view of the baffle assembly, illustrating (i) a first lateral vertical wall, a top wall, and a forward wall defining the top outlet disposed at one side of the baffle assembly and (ii) the first lateral wall, a bottom wall, and the forward wall defining the bottom outlet disposed at the one side of the baffle assembly.
Figure 7:
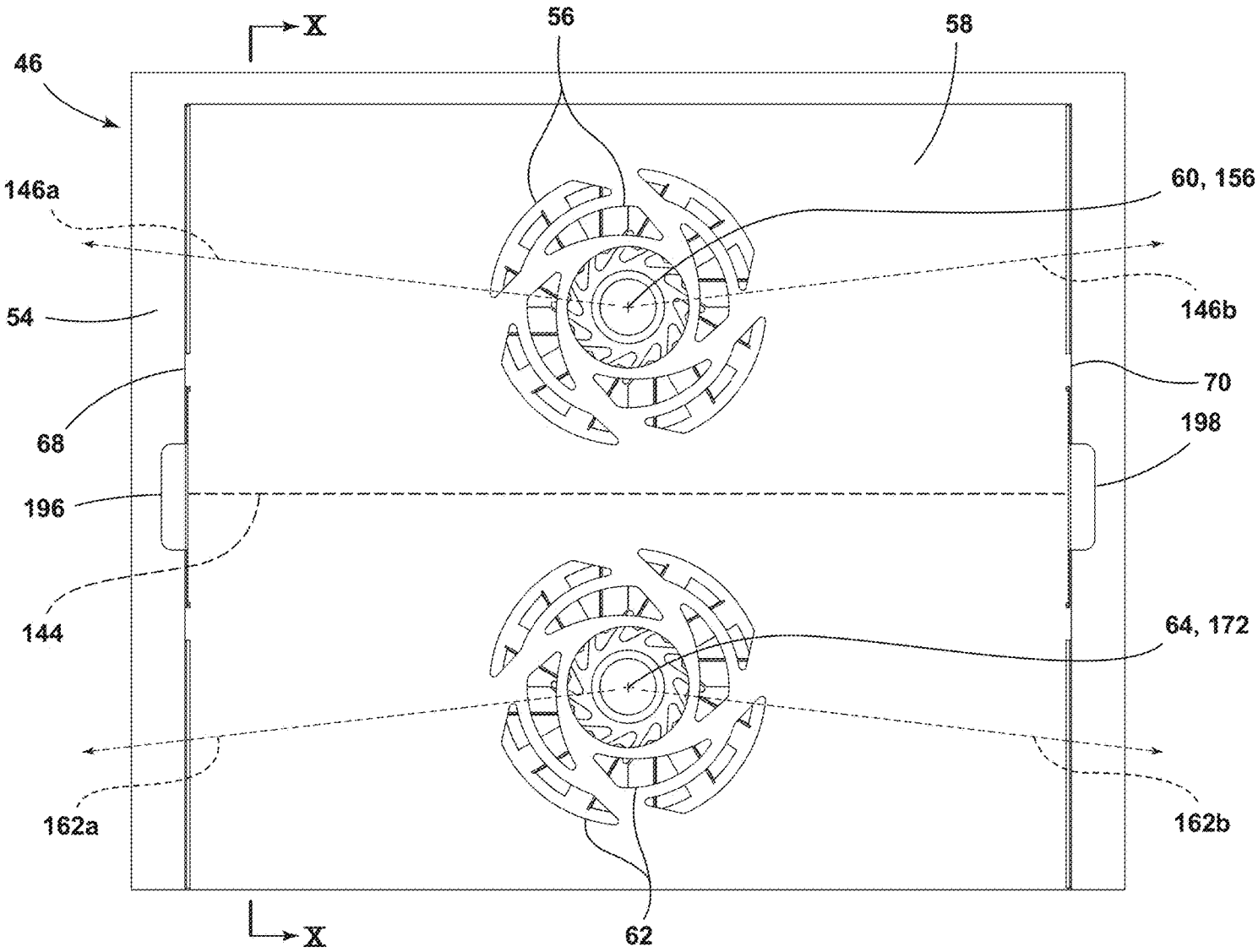
FIG. 7 is an elevational view of the baffle assembly, illustrating (in phantom) (i) top air flow paths for air that is drawn into the baffle assembly through the top inlet and (ii) bottom air flow paths for air that is drawn into the baffle assembly through the bottom inlet.
Figure 8:
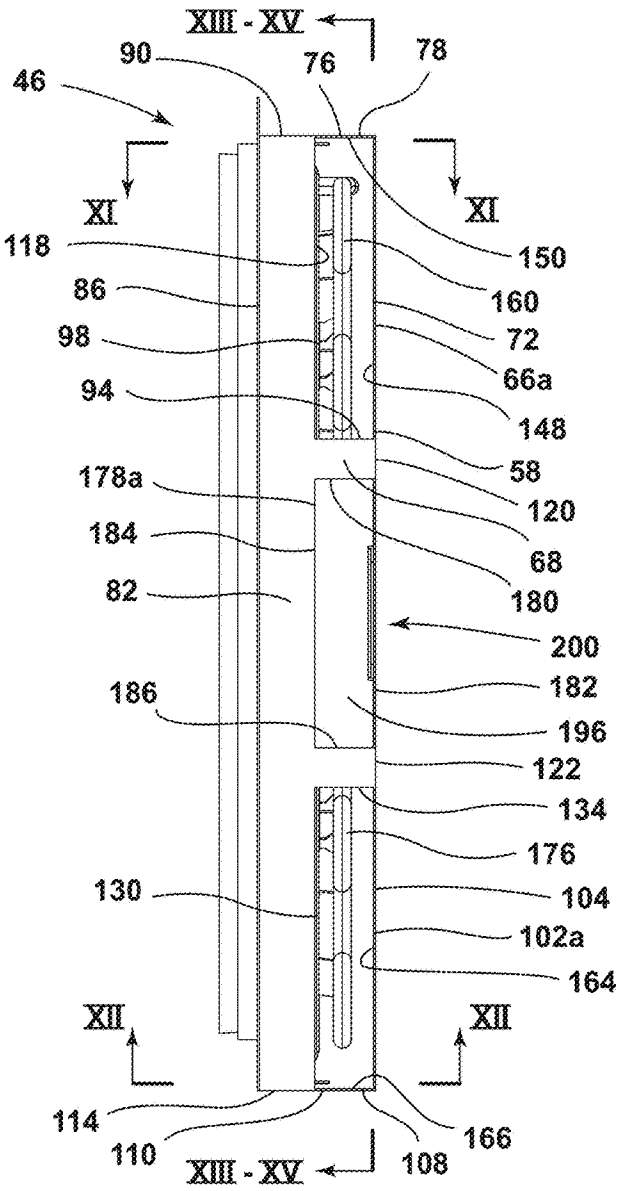
FIG. 8 is an elevational view of one side of the baffle assembly, illustrating a top heating element and a bottom heating element rearward of the forward wall to heat the air in the top air flow paths separately from the air in the bottom air flow paths.
Figure 9:
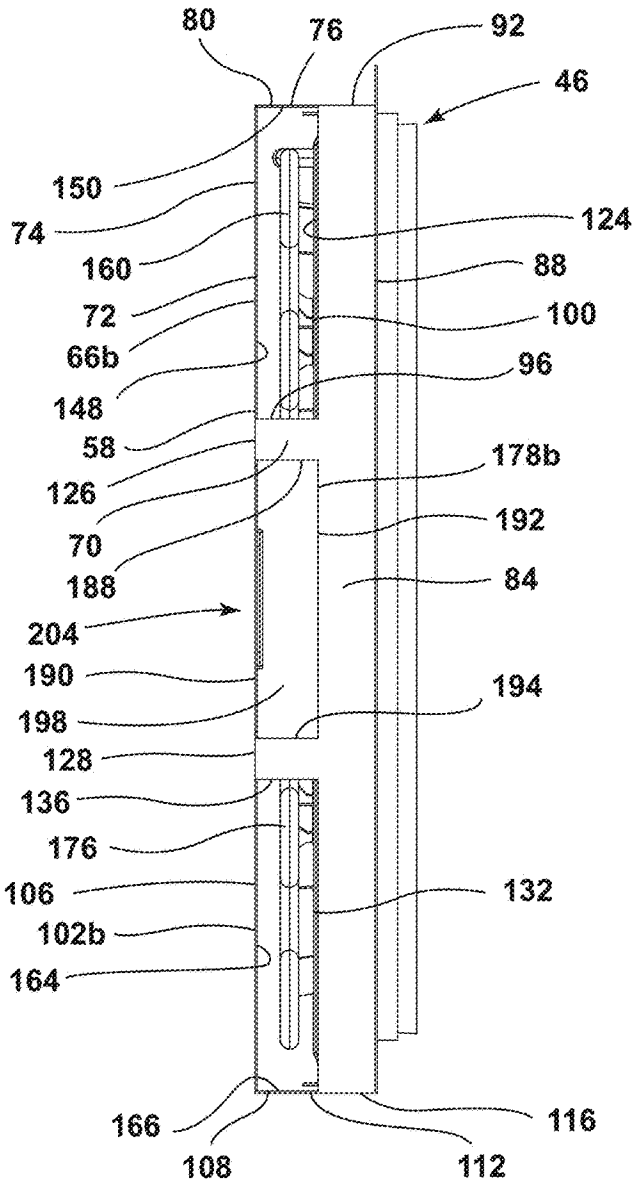
FIG. 9 is an elevational view of another side of the baffle assembly, illustrating (i) a second lateral vertical wall, the top wall, and the forward wall defining a top outlet disposed at another side of the baffle assembly and (ii) the second lateral wall, the bottom wall, and the forward wall defining the bottom outlet disposed at the other side of the baffle assembly.
Figure 10:
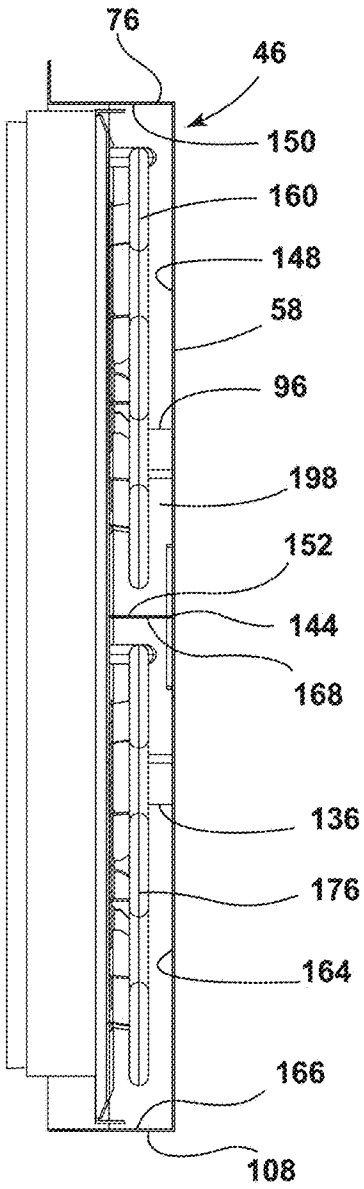
FIG. 10 is a side elevational view of a cross-section of the baffle assembly taken at line X-X of FIG. 7, illustrating the baffle assembly further including a middle wall disposed between the top wall and the bottom wall of the baffle assembly to segregate (i) the top air flow paths from the bottom air flow paths and (ii) the top heating element from the bottom heating element.
Figure 11:
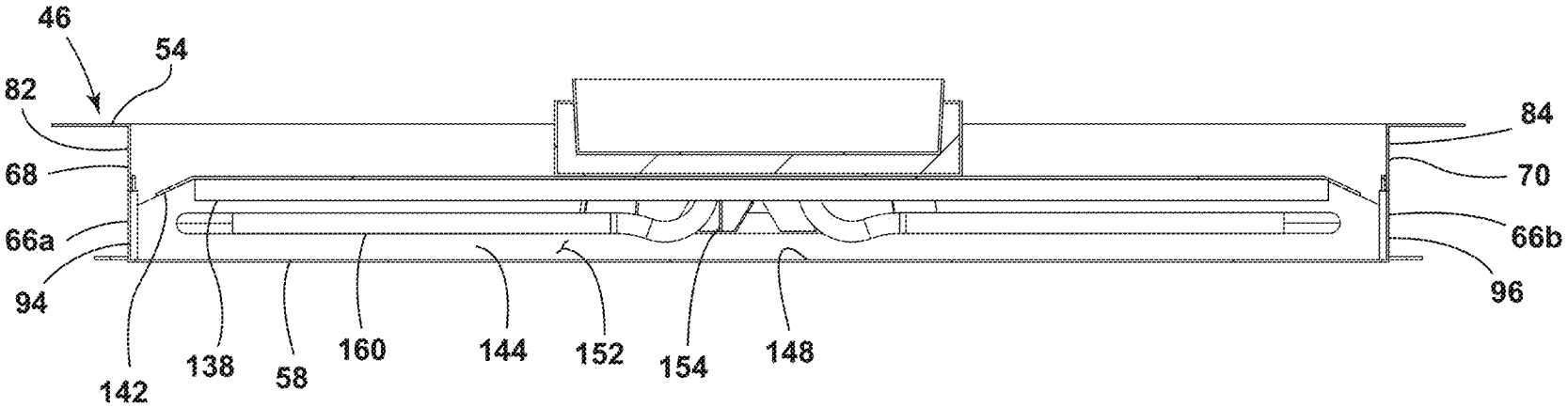
FIG. 11 is an overhead view of a cross-section of the baffle assembly taken through line XI-XI of FIG. 8, illustrating a top fan also disposed above the middle wall to cause air to flow from the cooking chamber, through the top air flow paths, and then back into cooking chamber through the top outlets.
Figure 12:
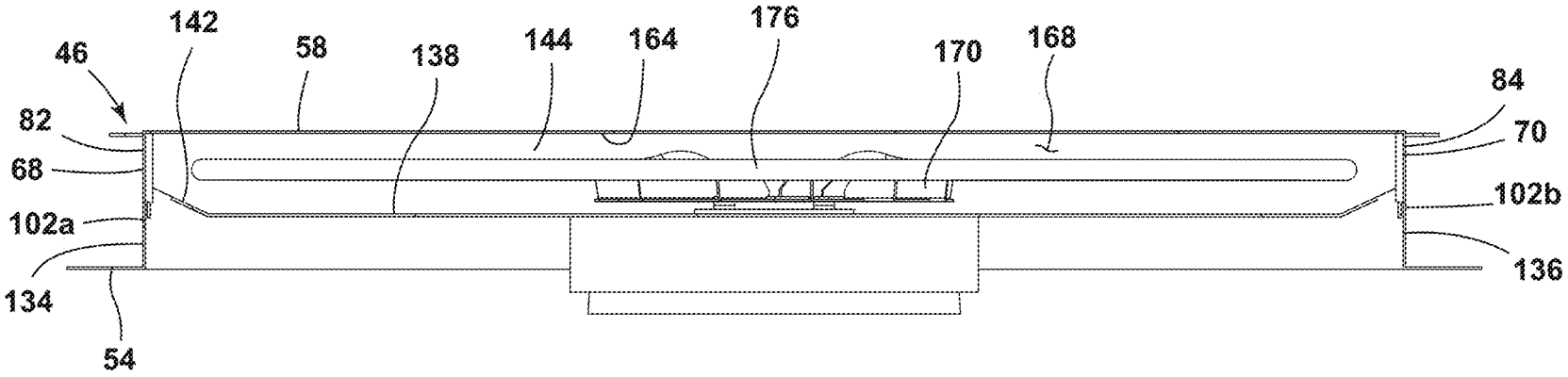
FIG. 12 is an underneath view of a cross-section of the baffle assembly taken through line XII-XII of FIG. 8, illustrating a bottom fan also disposed above the middle wall to cause air to flow from the cooking chamber, through the bottom air flow paths, and then back into the cooking chamber through the bottom outlets.
Figure 13:
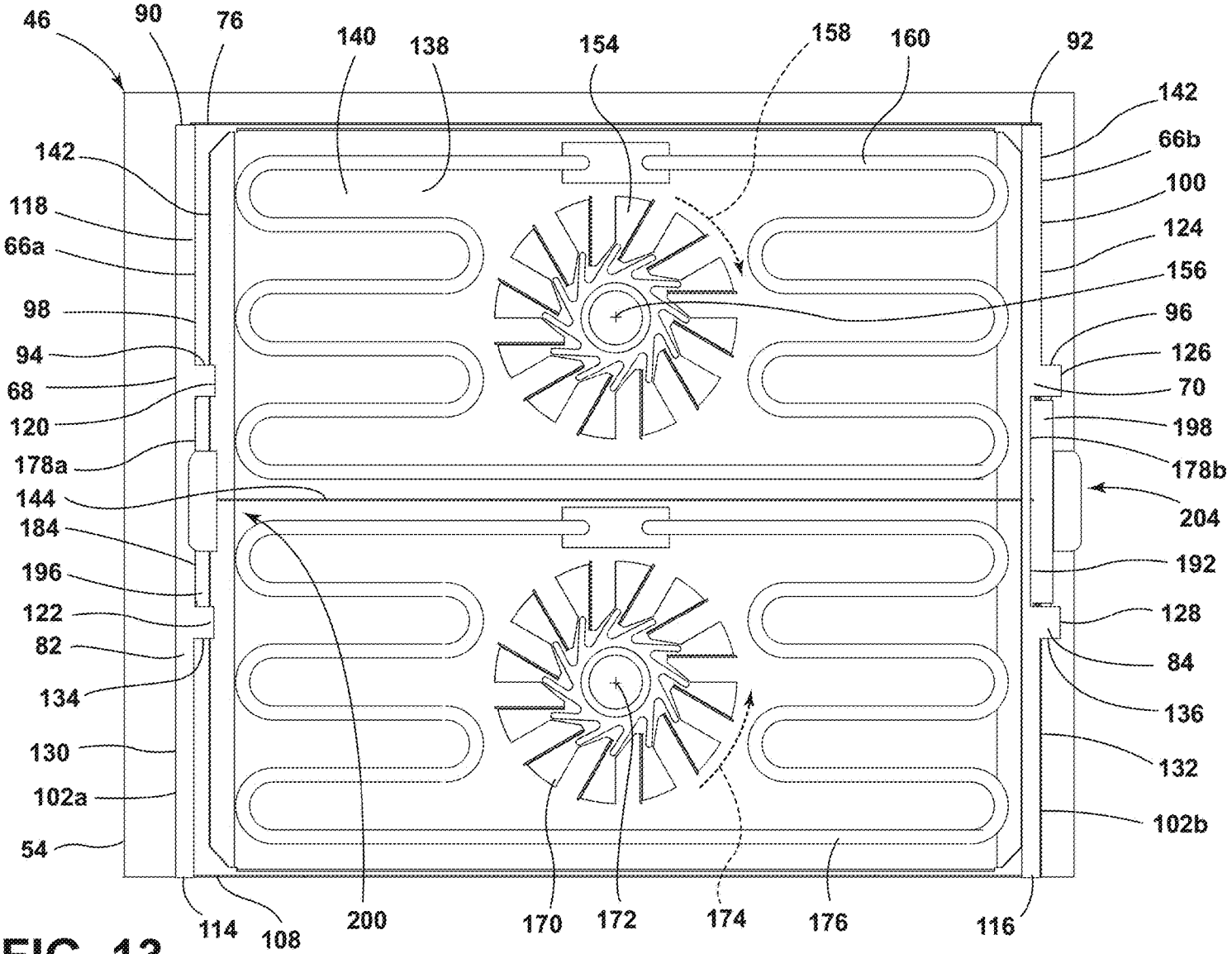
FIG. 13 is an elevational view of a cross-section of the baffle assembly taken through line XIII-XIII of FIG. 8, illustrating the top fan, the top heating element, the middle wall, the bottom fan, and the bottom heating element all disposed at least in part forward from a rear wall of the baffle assembly.
Figure 14:
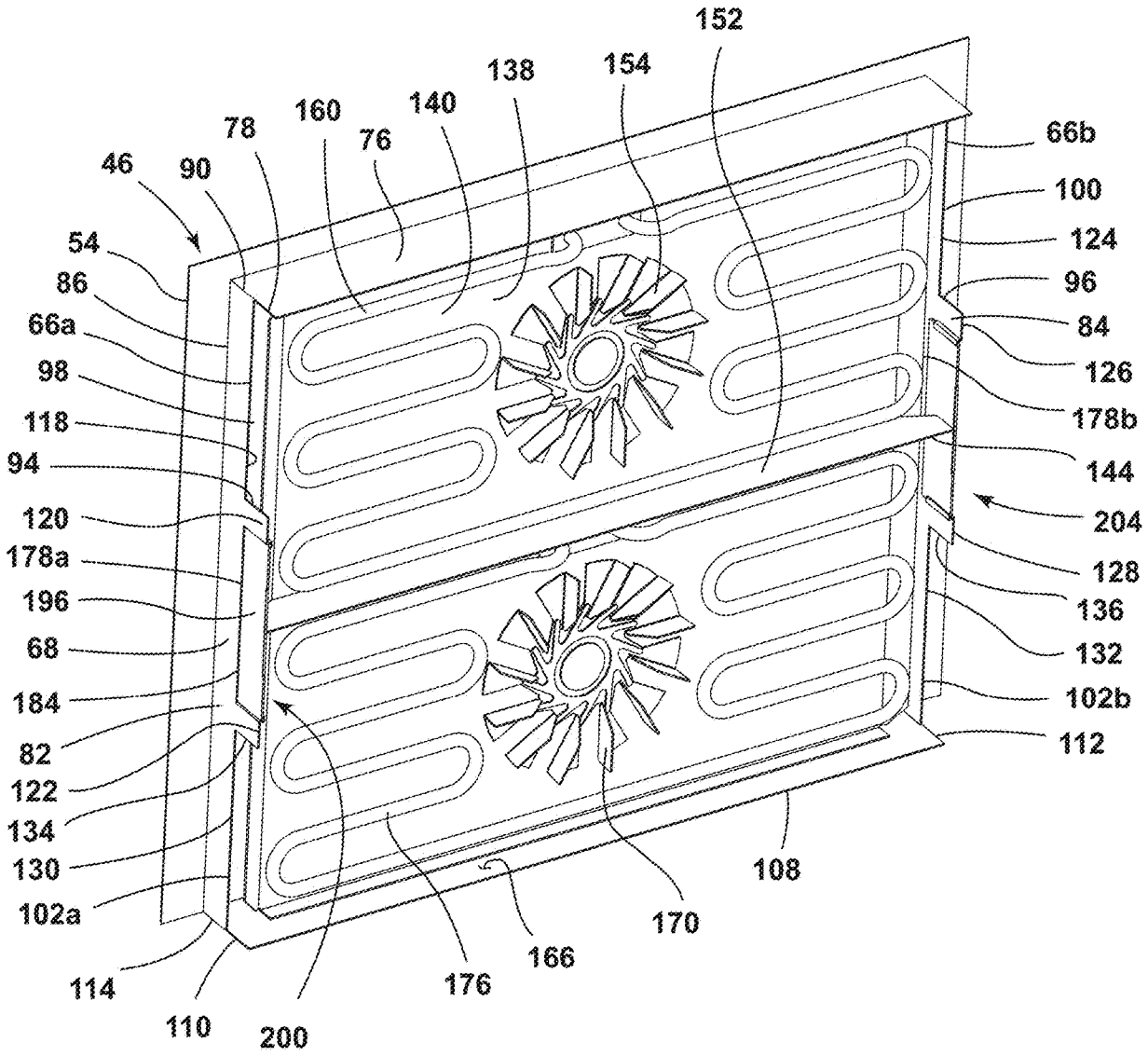
FIG. 14 is a perspective view of the same cross-section as FIG. 13, illustrating the top wall of the baffle assembly forming a top of the top outlet disposed at the one side of the baffle assembly and the bottom wall of the baffle assembly forming a bottom of the bottom outlet disposed at the one side of the baffle assembly.
Figure 15:
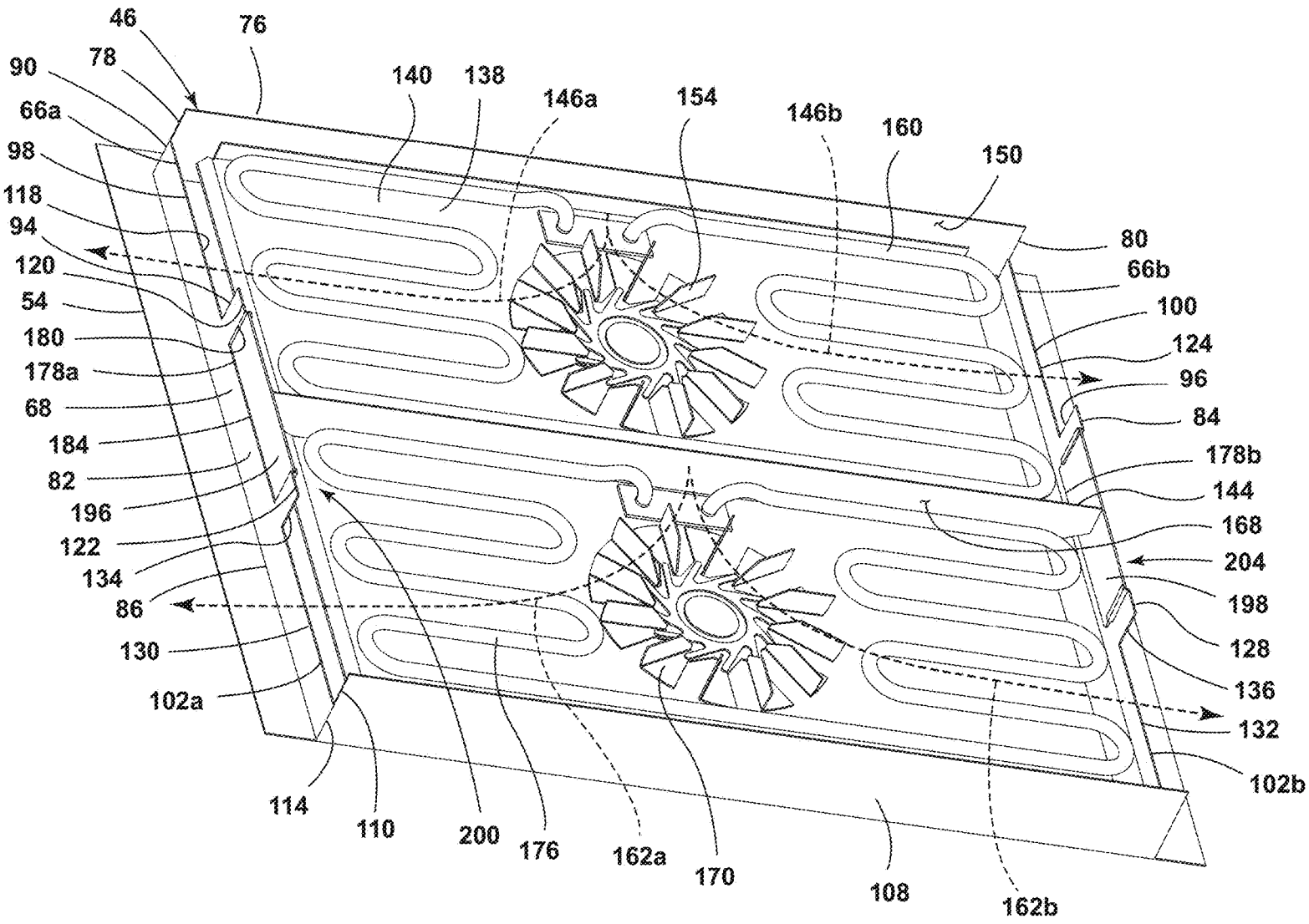
FIG. 15 is a perspective view of the same cross-section as FIG. 13, illustrating (i) the top air flow paths that occur rearward of the forward wall of the baffle assembly and (ii) the bottom air flow paths that occur rearward of the forward wall of the baffle assembly below the top air flow paths.
Figure 16:
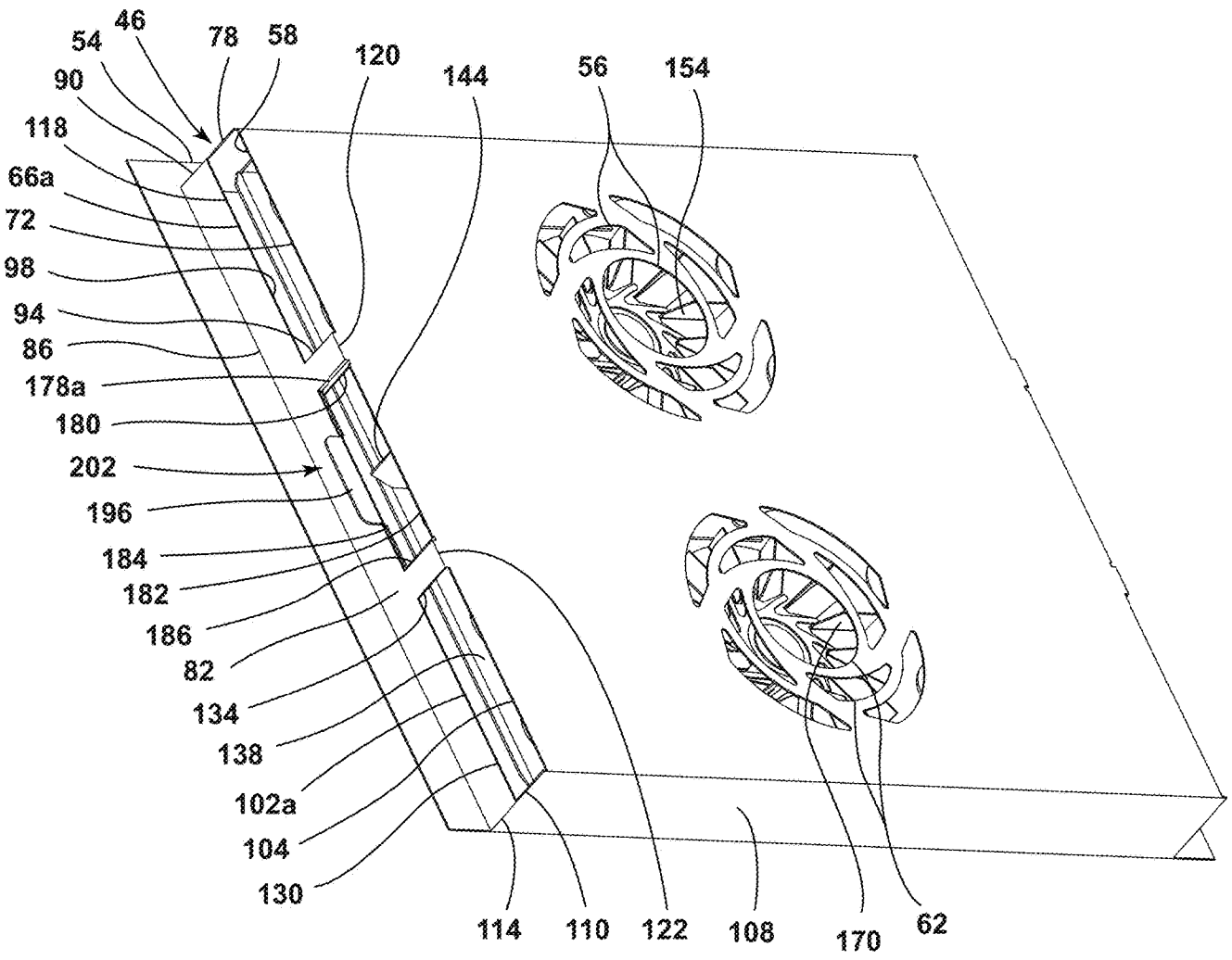
FIG. 16 is another perspective view of the baffle assembly, illustrating a first door disposed at the one side of the baffle assembly in an open position to reveal a middle outlet disposed between the top outlet and the bottom outlet, the middle outlet being aligned with the middle wall to outlet air from both the top air flow path and the bottom air flow path.

As mentioned, the door 14 of the oven 10 provides selective access to the cooking chamber 12. More specifically, the door 14 includes a closed position 42 (FIG. 1) and an open position 44 (FIG. 2). In the closed position 42, the door 14 covers the opening 32 into the cooking chamber 12 and prevents access to the cooking chamber 12 from the external environment 16. In the open position 44, the door 14 allows access through the opening 32 into the cooking chamber 12 from the external environment 16. The door 14 is movable (such as via user interaction with the door 14) to, from, and between the closed position 42 and the open position 44.

Referring now additionally to FIGS. 6-17, the oven 10 further includes a baffle assembly 46. As will be discussed, the baffle assembly 46 contributes to the generation and maintenance of a top region 48 (see FIG. 18) and a bottom region 50 of air flow 52 within the cooking chamber 12 having distinct temperatures, although the cooking chamber 12 is free of a solid matter barrier physically dividing the cooking chamber 12 between the top wall 30*b* and the bottom wall 30*c*. The top region 48 and the bottom region 50 of air flow 52 having distinct temperatures permit the user to cook two food items 18 simultaneously at those two different temperatures. In embodiments, the baffle assembly 46 is attached to the rear wall 30*a* that partially defines the cooking chamber 12 and projects forward from the rear wall 30*a* toward the opening 32 into the cooking chamber 12. For example, the baffle assembly 46 can include, as illustrated, a perimeter flange 54, which can be fastened, welded, or otherwise attached to the rear wall 30*a* that partially defines the cooking chamber 12. In embodiments, the perimeter flange 54 is generally planar and disposed vertically. In embodiments, the perimeter flange 54 is set flush against the rear wall 30*a* that partially forms the cooking chamber 12.

The baffle assembly 46 includes a top inlet 56 that is positioned to draw air from the cooking chamber 12. In embodiments, the baffle assembly 46 includes a forward wall 58, and the top inlet 56 is disposed through the forward wall 58. The forward wall 58 can be the most forward component of the baffle assembly 46, that is, the component of the baffle assembly 46 that is closest to the opening 32 of the cooking chamber 12 and furthest from the rear wall 30*a* that defines in part the cooking chamber 12. The forward wall 58 can be generally planar and disposed generally vertically. The top inlet 56 can comprise one or more apertures through the forward wall 58. In embodiments, the top inlet 56 includes apertures that are radially disposed about a center point 60 (see FIG. 7). In embodiments, as illustrated, some or all of the apertures collectively forming the top inlet 56 can be irregularly shaped. As further discussed below, air from the cooking chamber 12 enters the baffle assembly 46 through the top inlet 56.

The baffle assembly 46 further includes a bottom inlet 62 that is positioned to draw air from the cooking chamber 12. The top inlet 56 is elevated higher than the bottom inlet 62. In embodiments of the baffle assembly 46 that include the forward wall 58, the bottom inlet 62 is disposed through the forward wall 58. The bottom inlet 62 can comprise one or more apertures through the forward wall 58. In embodiments, the bottom inlet 62 includes apertures that are radially disposed about a center point 64. In embodiments, as illustrated, some or all of the apertures collectively forming the bottom inlet 62 can be irregularly shaped. As further discussed below, air from the cooking chamber 12 enters the baffle assembly 46 through the bottom inlet 62.

The baffle assembly 46 further includes a pair of top outlets 66*a*, 66*b*. The top outlets 66*a*, 66*b* are disposed laterally away from the top inlet 56. In other words, the top outlet 66*a* is disposed closer to the lateral wall 30*d* partially defining the cooking chamber 12, and the top outlet 66*b* is disposed closer to the lateral wall 30*e* partially defining the cooking chamber 12. The top outlet 66*a* is disposed at one side 68 of the baffle assembly 46, and the top outlet 66*b* is disposed at another side 70 of the baffle assembly 46. In embodiments, the forward wall 58 of the baffle assembly 46 defines a forward portion 72 of the top outlet 66*a* disposed at the one side 68, and a forward portion 74 of the top outlet 66*b* disposed at the other side 70 of the baffle assembly 46.

The pair of top outlets 66*a*, 66*b* are positioned to return air to the cooking chamber 12. For example, the pair of top outlets 66*a*, 66*b* are open to the cooking chamber 12. As further discussed below, air that had entered the baffle assembly 46 through the top inlet 56 subsequently exits the baffle assembly 46 and reenters the cooking chamber 12 through the pair of top outlets 66*a*, 66*b*.

In embodiments, the baffle assembly 46 further includes a top wall 76. The top wall 76 is generally planar and disposed generally horizontally. In embodiments, the top wall 76 is generally parallel to the top wall 30*b* partially defining the cooking chamber 12. In embodiments, the top wall 76 is generally orthogonal to the forward wall 58 of the baffle assembly 46, and extends rearward therefrom. In other words, the forward wall 58 is disposed forward of the top wall 76. The top wall 76 defines a top 78 of the top outlet 66*a*, and a top 80 of the top outlet 66*b*. In embodiments, the top 78 of the top outlet 66*a* and the top 80 of the top outlet 66*b* are parallel, and in embodiments, coplanar. In embodiments, the tops 78, 80 of the top outlets 66*a*, 66*b* are generally orthogonal to the forward portions 72, 74 of the top outlets 66*a*, 66*b*, respectively.

In embodiments, the baffle assembly 46 further includes (i) a first lateral vertical wall 82 at the one side 68 of the baffle assembly 46 and (ii) a second lateral vertical wall 84 at the other side 70 of the baffle assembly 46. Both the first lateral vertical wall 82 and the second lateral vertical wall 84 are generally planar and disposed vertically. Both the first lateral vertical wall 82 and the second lateral vertical wall 84 extend rearward from the forward wall 58 of the baffle assembly 46 and toward the rear wall 30*a* that partially defines the cooking chamber 12. Both the first lateral vertical wall 82 and the second lateral vertical wall 84 extend forward from the perimeter flange 54. Both the first lateral vertical wall 82 and the second lateral vertical include a rear 86, 88, respectively, that coincides with the perimeter flange 54. Both the first lateral vertical wall 82 and the second lateral vertical wall 84 include a top 90, 92, respectively, that coincides with the top wall 76. In embodiments, the first lateral vertical wall 82 and the second lateral vertical wall 84 are parallel to each other and orthogonal to the forward wall 58 and the top wall 76 of the baffle assembly 46.

In embodiments, as illustrated, the first lateral vertical wall 82 defines a bottom 94 of the top outlet 66*a* disposed at the one side 68 of the baffle assembly 46. In embodiments, as illustrated, the second lateral vertical wall 84 defines a bottom 96 of the top outlet 66*b* disposed at the other side 70 of the baffle assembly 46. In embodiments, the bottoms 94, 96 of the top outlets 66*a*, 66*b* are parallel to the tops 78, 80 of the top outlets 66*a*, 66*b*, respectively, and orthogonal to the forward portions 72, 74 of the top outlets 66*a*, 66*b*, respectively.

In embodiments, as illustrated, the first lateral vertical wall 82 defines a rear portion 98 of the top outlet 66*a* disposed at one side 68 of the baffle assembly 46. In embodiments, as illustrated, the second lateral vertical wall 84 defines a rear portion 100 of the top outlet 66*b* disposed at the other side 70 of the baffle assembly 46. The rear portions 98, 100 of the top outlets 66*a*, 66*b* can be, as illustrated, parallel and coplanar with each other, and orthogonal to the tops 78, 80 and bottoms 94, 96 of the top outlets 66*a*, 66*b*, respectively.

The baffle assembly 46 further includes a pair of bottom outlets 102*a*, 102*b*. The bottom outlets 102*a*, 102*b* are disposed laterally away from the bottom inlet 62. In other words, the bottom outlet 102*a* is disposed closer to the lateral wall 30*d* partially defining the cooking chamber 12, and the bottom outlet 102*b* is disposed closer to the lateral wall 30*e* partially defining the cooking chamber 12. The bottom outlet 102*a* is disposed at the one side 68 of the baffle assembly 46, and the bottom outlet 102*b* is disposed at the other side 70 of the baffle assembly 46. In embodiments, the forward wall 58 of the baffle assembly 46 defines a forward portion 104 of the bottom outlet 102*a* disposed at the one side 68, and a forward portion 106 of the bottom outlet 102*b* disposed at the other side 70 of the baffle assembly 46.

The pair of bottom outlets 102*a*, 102*b* are positioned to return air to the cooking chamber 12. For example, the pair of bottom outlets 102*a*, 102*b* are open to the cooking chamber 12. As further discussed below, air that had entered the baffle assembly 46 through the bottom inlet 62 is kept generally segregated from air that had entered the baffle assembly 46 through the top inlet 56 and subsequently exits the baffle assembly 46 and reenters the cooking chamber 12 through the pair of bottom outlets 102*a*, 102*b*.

In embodiments, the baffle assembly 46 further includes a bottom wall 108. The bottom wall 108 is generally planar and disposed generally horizontally. The bottom wall 108 is disposed closer to the bottom wall 30*c* partially defining the cooking chamber 12 than to the top wall 76 of the baffle assembly 46. The bottom wall 108 is generally parallel to the top wall 76 of the baffle assembly 46 and the bottom wall 30*c* partially defining the cooking chamber 12. In embodiments, the bottom wall 108 is generally orthogonal to the forward wall 58 of the baffle assembly 46, and extends rearward therefrom. In other words, the forward wall 58 is disposed forward of the bottom wall 108. The bottom wall 108 defines a bottom 110 of the bottom outlet 102*a*, and a bottom 112 of the bottom outlet 102*b*. In embodiments, the bottom 110 of the bottom outlet 102*a* and the bottom 112 of the bottom outlet 102*b* are parallel, and in embodiments, coplanar. In embodiments, the bottoms 110, 112 of the bottom outlets 102*a*, 102*b* are generally orthogonal to the forward portions 104, of the bottom outlets 102*a*, 102*b*, respectively. In embodiments, the top 78 of the top outlet 66*a* at the one side 68 and the bottom 110 of the bottom outlet 102*a* at the one side 68 are parallel. In embodiments, the top 80 of the top outlet 66*b* at the other side 70 and the bottom 112 of the bottom outlet 102*b* at the other side 70 are parallel.

In embodiments, both the first lateral vertical wall 82 and the second lateral vertical wall 84 include a bottom 114, 116, respectively, that coincides with the bottom wall 108. In embodiments, the first lateral vertical wall 82 includes a front 118 that faces forward. The front 118 does not coincide with the forward wall 58 except at a top tab 120 and a bottom tab 122 disposed between the top 90 and bottom 114 of the first lateral vertical wall 82 that extend forward to coincide with the forward wall 58.

In embodiments, the second lateral vertical wall 84 includes a front 124 that faces forward. The front 124 does not coincide with the forward wall 58 except at a top tab 126 and a bottom tab 128 disposed between the top 92 and the bottom 116 of the second lateral vertical wall 84 that extend forward to coincide with the forward wall 58.

In embodiments, as illustrated, the first lateral vertical wall 82 defines a rear portion 130 of the bottom outlet 102*a* disposed at the one side 68 of the baffle assembly 46. In embodiments, as illustrated, the second lateral vertical wall 84 defines a rear portion 132 of the bottom outlet 102*b* disposed at the other side 70 of the baffle assembly 46. The rear portions 130, 132 of the bottom outlets 102*a*, 102*b* can be, as illustrated, parallel and coplanar with each other, and orthogonal to the tops and the bottoms 110, 112 of the bottom outlets 102*a*, 102*b*, respectively.

In embodiments, as illustrated, the first lateral vertical wall 82 defines a top 134 of the bottom outlet 102*a* at the one side 68 of the baffle assembly 46. In embodiments, as illustrated, the second lateral vertical wall 84 defines a top 136 of the bottom outlet 102*b* at the other side 70 of the baffle assembly 46. In embodiments, the tops 134, 136 of the bottom outlets 102*a*, 102*b* are parallel to the bottoms 110, 112 of the bottom outlets 102*a*, 102*b*, respectively, and orthogonal to the forward portions 104, 106 of the bottom outlets 102*a*, 102*b*, respectively. The first lateral vertical wall 82 separates the bottom 94 of the top outlet 66*a* from the top 134 of the bottom outlet 102*a* at the one side 68 of the baffle assembly 46. The second lateral vertical wall 84 separates the bottom 96 of the top outlet 66*b* from the top 136 of the bottom outlet 102*b* at the other side 70 of the baffle assembly 46.

The top inlet 56 and the pair of top outlets 66*a*, 66*b* are elevated higher than the bottom inlet 62 and the pair of bottom outlets 102*a*, 102*b*. For example, the top inlet 56 and the pair of top outlets 66*a*, 66*b* are disposed closer to the top wall 30*b* that partially defines the cooking chamber 12 than the bottom inlet 62 and the pair of bottom outlets 102*a*, 102*b*. In turn, the bottom inlet 62 and the pair of bottom outlets 102*a*, 102*b* are disposed closer to the bottom wall 30*c* that partially defines the cooking chamber 12 than the top inlet 56 and the pair of top outlets 66*a*, 66*b*. As will be further discussed, so placing the top inlet 56, the pair of top outlets 66*a*, 66*b*, the bottom inlet 62, and the pair of bottom outlets 102*a*, 102*b* allows for the generation of the top region 42 and the bottom region 50 of air flow 52 within the cooking chamber 12, with the top region 42 and the bottom region 50 having distinct temperatures.

In embodiments, the baffle assembly 46 further includes a rear wall 138. The rear wall 138 is disposed rearward of the forward wall 58—that is, closer to the rear wall 30*a* that partially defines the cooking chamber 12 than the forward wall 58 of the baffle assembly 46. The rear wall 138 can include a portion 140 that is centrally disposed, generally planar, and disposed generally vertically. In addition, the rear wall 138 can include lateral edges 142 that extend forward from the portion 140 that is planar. The lateral edges 142 direct air flow toward the pair of top outlets 66*a*, 66*b* and the pair of bottom outlets 102*a*, 102*b*.

The baffle assembly 46 further includes a middle wall 144. The middle wall 144 is disposed between the top wall 76 and the bottom wall 108. In embodiments, the middle wall 144 is generally planar and disposed generally horizontally. The middle wall 144 is disposed between the rear wall 138 and the forward wall 58 of the baffle assembly 46, and extends rearward from the forward wall 58 of the baffle assembly 46 and forward from the rear wall 138 of the baffle assembly 46. In other words, the forward wall 58 is disposed forward of the middle wall 144. The middle wall 144 extends laterally from the first lateral vertical wall 82 to the second lateral vertical wall 84. In embodiments, the middle wall 144 is generally parallel to the top wall 76 and the bottom wall 108 of the baffle assembly 46, and generally orthogonal to the rear wall 138, the first lateral vertical wall 82, and the second lateral vertical wall 84 of the baffle assembly 46. As further discussed below, the middle wall 144 of the baffle assembly 46 maintains vertical segregation of air flow through the baffle assembly 46.

In embodiments, as suggested above, the top wall 76, the forward wall 58, and the first lateral vertical wall 82 cooperate to form the top outlet 66*a* disposed at the one side 68 of the baffle assembly 46. The top tab 120 of the first lateral vertical wall 82 is disposed elevationally higher than the middle wall 144. The bottom tab 122 of the first lateral vertical wall 82 is disposed elevationally lower than the middle wall 144. The top outlet 66*a* is disposed elevationally above the middle wall 144. In embodiments, the top tab 120 of the first lateral vertical wall 82 forms the bottom 94 of the top outlet 66*a*. Similarly, as suggested above, the bottom wall 108, the forward wall 58, and the first lateral vertical wall 82 cooperate to form the bottom outlet 102*a*. The bottom outlet 102*a* is disposed elevationally below the middle wall 144. In embodiments, the bottom tab 122 of the first lateral vertical wall 82 forms the top 134 of the bottom outlet 102*a*.

In embodiments, as suggested above, the top wall 76, the forward wall 58, and the second lateral vertical wall 84 cooperate to form the top outlet 66*b* disposed at the other side 70 of the baffle assembly 46. The top tab 126 is disposed elevationally higher than the middle wall 144. The bottom tab 128 is disposed elevationally lower than the middle wall 144. The top outlet 66*b* is disposed elevationally higher than the middle wall 144. In embodiments, the top tab 126 of the second lateral vertical wall 84 forms the bottom 96 of the top outlet 66*b*. Similarly, as suggested above, the bottom wall 108, the forward wall 58, and the second lateral vertical wall 84 cooperate to form the bottom outlet 102*b*. The bottom outlet 102*b* is disposed elevationally lower than the middle wall 144. In embodiments, the bottom tab 128 of the second lateral vertical wall 84 forms the top 136 of the bottom outlet 102*b*.

The baffle assembly 46 further includes top air flow paths 146*a*, 146*b* (see FIGS. 7 and 15) that are at least partially segregated from the cooking chamber 12. The top air flow paths 146*a*, 146*b* guide air to flow from the cooking chamber 12, into the top inlet 56, rearward of the forward wall 58, and then out the top outlets 66*a*, 66*b*, respectively, back into the cooking chamber 12. The top wall 76, the forward wall 58, the first lateral vertical wall 82, the second lateral vertical wall 84, and the middle wall 144 cooperate to form the top air flow paths 146*a*, 146*b*. The forward wall 58, the top wall 76, the middle wall 144, the first lateral vertical wall 82, the second lateral vertical wall 84, and the rear wall 138 of the baffle assembly 46 guide the air that enters the top inlet 56 from the cooking chamber 12 to the pair of top outlets 66*a*, 66*b*.

The top inlet 56 through the forward wall 58 is disposed elevationally above the middle wall 144. The bottom inlet 62 through the forward wall 58 is disposed elevationally below the middle wall 144. The forward wall 58 coincides with the top wall 76, the bottom wall 108, the middle wall 144, the top tab 120 and bottom tab 122 of the first lateral vertical wall 82, and the top tab 126 and bottom tab 128 of the second lateral vertical wall 84. The forward wall 58 defines a forward surface 148 of the top air flow paths 146*a*, 146*b*. The top wall 76 defines a top surface 150 of the top air flow paths 146*a*, 146*b*. The middle wall 144 defines a bottom surface 152 of the top air flow paths 146*a*, 146*b*, and the bottom surface 152 opposes the top surface 150. In embodiments, the top surface 150 and the bottom surface 152 of the top air flow paths 146*a*, 146*b* are generally horizontal. In embodiments, the forward surface 148 of the top air flow paths 146*a*, 146*b* is generally vertical.

The oven 10 further includes a top fan 154. The top fan 154 is positioned to force air to flow from the cooking chamber 12, through the top inlet 56, through the top air flow paths 146*a*, 146*b*, through the pair of top outlets 66*a*, 66*b*, and then back into the cooking chamber 12. For example, in embodiments, the top fan 154 is disposed rearward of the forward wall 58 of the baffle assembly 46, such as between the rear wall 138 and the forward wall 58 of the baffle assembly 46. The top fan 154 is disposed between the middle wall 144 and the top wall 76 of the baffle assembly 46. In embodiments, the top fan 154 has an axis of rotation 156 that extends through the top inlet 56. The top fan 154 rotates in a direction 158 (see FIG. 13) that sucks air in to the baffle assembly 46 through the top inlet 56.

The oven 10 further includes a top heating element 160. The top heating element 160 is positioned to heat air flowing through the top air flow paths 146*a*, 146*b*. For example, in embodiments, top heating element 160 is disposed rearward of the forward wall 58 of the baffle assembly 46, such as between the rear wall 138 and the forward wall 58 of the baffle assembly 46. The top heating element 160 is disposed between the middle wall 144 and the top wall 76 of the baffle assembly 46. In embodiments, the top heating element 160 is disposed both (i) between the axis of rotation 156 of the top fan 154 and the one side 68 of the baffle assembly 46 and (ii) between the axis of rotation 156 of the top fan 154 and the other side 70 of the of the baffle assembly 46. In embodiments, the top heating element 160 is further disposed between the axis of rotation 156 of the top fan 154 and the middle wall 144 of the baffle assembly 46. Accordingly, regardless of whether the air flowing through the top air flow paths 146*a*, 146*b* flows from the top inlet 56 to the top outlet 66*a* on the one side 68 of the baffle assembly 46 (i.e., top air flow path 146*a*) or to the top outlet 66*b* on the other side 70 of the baffle assembly 46 (i.e., top air flow path 146*b*), the top heating element 160 is able to increase or maintain the temperature of the air returning through the pair of top outlets 66*a*, 66*b* to the cooking chamber 12.

The baffle assembly 46 further includes bottom air flow paths 162*a*, 162*b* (see FIGS. 7 and 15) that are at least partially segregated from the cooking chamber 12. The bottom air flow paths 162*a*, 162*b* guide air to flow from the cooking chamber 12, into the bottom inlet 62, rearward of the forward wall 58, and then out the bottom outlets 102*a*, 102*b*, respectively, and back into the cooking chamber 12. The bottom wall 108, the forward wall 58, the first lateral vertical wall 82, the second lateral vertical wall 84, and the middle wall 144 cooperate to form the bottom air flow paths 162*a*, 162*b*.

The forward wall 58, the bottom wall 108, the middle wall 144, the rear wall 138, the first lateral vertical wall 82, and the second lateral vertical wall 84 of the baffle assembly 46 guide the air that enters the bottom inlet 62 from the cooking chamber 12 to the pair of bottom outlets 102*a*, 102*b*. The forward wall 58 defines a forward surface 164 of the bottom air flow paths 162*a*, 162*b*. The bottom wall 108 defines a bottom surface 166 of the bottom air flow paths 162*a*, 162*b*. The middle wall 144 defines a top surface 168 of the bottom air flow paths 162*a*, 162*b*, and the top surface 168 opposes the bottom surface 166. In embodiments, the top surface 168 and the bottom surface 166 of the bottom air flow paths 162*a*, 162*b* are generally horizontal. In embodiments, the forward surface 164 of the bottom air flow paths 162*a*, 162*b* is generally vertical.

The oven 10 further includes a bottom fan 170. The bottom fan 170 is positioned to force air to flow from the cooking chamber 12, through the bottom inlet 62, through the bottom air flow paths 162*a*, 162*b*, through the pair of bottom outlets 102*a*, 102*b*, and then back into the cooking chamber 12. For example, in embodiments, the bottom fan 170 is disposed rearward of the forward wall 58 of the baffle assembly 46, such as between the rear wall 138 and the forward wall 58 of the baffle assembly 46. The bottom fan 170 is disposed between the middle wall 144 and the bottom wall 108 of the baffle assembly 46. In embodiments, the bottom fan 170 has an axis of rotation 172 (see FIGS. 7, 13) that extends through the bottom inlet 62. The bottom fan 170 rotates in a direction 174 that sucks in air to the baffle assembly 46 through the bottom inlet 62.

In embodiments, the direction 158 in which the top fan 154 spins is opposite of the direction 174 in which the bottom fan 170 spins. For example, in embodiments, the top fan 154 spins counterclockwise, while the bottom fan 170 spins clockwise. As another example, in embodiments, the top fan 154 spins clockwise, while the bottom fan 170 spins counterclockwise. In embodiments, the direction 158 in which the top fan 154 spins is the same as the direction 174 in which the bottom fan 170 spins (e.g., both spin clockwise).

The oven 10 further includes a bottom heating element 176. The bottom heating element 176 is positioned to heat air flowing through the bottom air flow paths 162*a*, 162*b*. For example, in embodiments, the bottom heating element 176 is disposed rearward of the forward wall 58 of the baffle assembly 46, such as between the rear wall 138 and the forward wall 58 of the baffle assembly 46. The bottom heating element 176 is disposed between the middle wall 144 and the bottom wall 108 of the baffle assembly 46. In embodiments, the bottom heating element 176 is disposed both (i) between the axis of rotation 172 of the bottom fan 170 and the one side 68 of the baffle assembly 46 and (ii) between the axis of rotation 172 of the bottom fan 170 and the other side 70 of the of the baffle assembly 46. In embodiments, the bottom heating element 176 is further disposed between the axis of rotation 172 of the bottom fan 170 and the middle wall 144 of the baffle assembly 46. Accordingly, regardless of whether the air flowing through the bottom air flow paths 162*a*, 162*b* flows from the bottom inlet 62 to the bottom outlet 102*a* on the one side 68 of the baffle assembly 46 (i.e., the bottom air flow path 162*a*) or to the bottom outlet 102*b* on the other side 70 of the baffle assembly 46 (i.e., the bottom air flow path 162*b*), the bottom heating element 176 is able to increase or maintain the temperature of the air returning through the pair of bottom outlets 102*a*, 102*b* to the cooking chamber 12.

In embodiments, the baffle assembly 46 further includes a pair of middle outlets 178*a*, 178*b*. The middle outlet 178*a* is disposed at the one side 68 of the baffle assembly 46, between the top outlet 66*a* and the bottom outlet 102*a* that are disposed at that side 68 of the baffle assembly 46. The forward wall 58 and the first lateral vertical wall 82 cooperate to form the middle outlet 178*a*. The middle outlet 178*a* is disposed to overlap elevationally with the middle wall 144. In other words, the middle wall 144, if it were to extend through the first lateral vertical wall 82, would extend through the middle outlet 178*a*. The top tab 120 of the first lateral vertical wall 82 forms a top 180 of the middle outlet 178*a*. The forward wall 58 forms a forward portion 182 of the middle outlet 178*a*. The first lateral vertical wall 82 forms a rear portion 184 of the middle outlet 178*a*. The bottom tab 122 of the first lateral vertical wall 82 forms a bottom 186 of the middle outlet 178*a*. The middle outlet 178*a* is disposed between the top outlet 66*a* and the bottom outlet 102*a* at the first lateral vertical wall 82.

The middle outlet 178*b* is disposed at the other side 70 of the baffle assembly 46, between the top outlet 66*b* and the bottom outlet 102*b* that are disposed at that other side 70 of the baffle assembly 46. The forward wall 58 and the second lateral vertical wall 84 cooperate to form the middle outlet 178*b*. The middle outlet 178*b* is disposed to overlap elevationally with the middle wall 144. In other words, the middle wall 144, if it were to extend through the second lateral vertical wall 84, would extend through the middle outlet 178*b*. The top tab 126 of the second lateral vertical wall 84 forms a top 188 of the middle outlet 178*b*. The forward wall 58 forms a forward portion 190 of the middle outlet 178*b*. The second lateral vertical wall 84 forms a rear portion 192 of the middle outlet 178*b*. The bottom tab 128 of the second lateral vertical wall 84 forms a bottom 194 of the middle outlet 178*b*. The middle outlet 178*b* is disposed between the top outlet 66*b* and the bottom outlet 102*b* at the second lateral vertical wall 84.

In embodiments, the baffle outlet further includes a pair of doors—a first door 196 disposed at the one side 68 of baffle assembly 46 and a second door 198 disposed at the other side 70 of the baffle assembly 46. The first door 196 has a closed position 200 and an open position 202 (see FIG. 16). In the closed position 200, the first door 196 closes the middle outlet 178*a* at the first lateral vertical wall 82. Thus, air flowing through the top air flow path 146*a* toward the top outlet 66*a* and through the bottom air flow path 162*a* toward the bottom outlet 102*a* at the one side 68 of the baffle assembly 46 does not also flow through the middle outlet 178*a*. The user can cause the first door 196 to move to, from, and between the open position 202 and the closed position 200. In embodiments, the first door 196 slides within a track or pocket of the first lateral vertical wall 82 to, from, and between the open position 202 and the closed position 200.

In the open position 202, the middle outlet 178*a* is open and access is allowed through the middle outlet 178*a* disposed at the first lateral vertical wall 82. Thus, air flowing through the top air flow path 146*a* toward the top outlet 66*a* and through the bottom air flow path 162*a* toward the bottom outlet 102*a* at the one side 68 of the baffle assembly 46 also flows through the middle outlet 178*a*.

Figure 17:
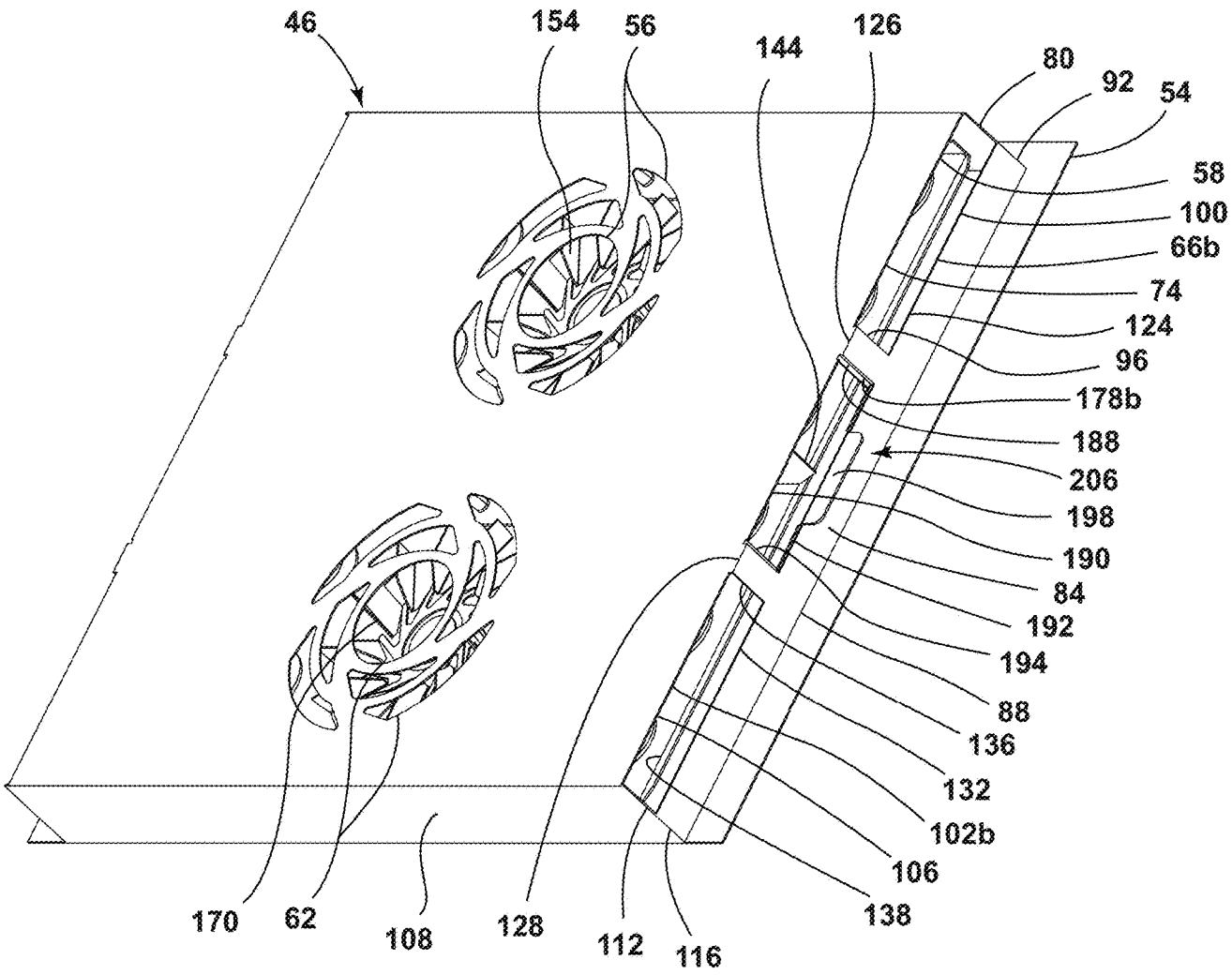
FIG. 17 is another perspective view of the baffle assembly, illustrating a second door disposed at the other side of the baffle assembly in an open position to reveal a middle outlet disposed between the top outlet and the bottom outlet, the middle outlet being aligned with the middle wall to outlet air from both the top air flow path and the bottom air flow path.

The second door 198 is has a closed position 204 and an open position 206 (see FIG. 17). In the closed position 204, the second door 198 closes the middle outlet 178*b* at the second lateral vertical wall 84. Thus, air flowing through the top air flow path 146*b* toward the top outlet 66*b* and through the bottom air flow path 162*b* toward the bottom outlet 102*b* at the other side 70 of the baffle assembly 46 does not also flow through the middle outlet 178*b*. The user can cause the second door 198 to move to, from, and between the open position 206 and the closed position 204. In embodiments, the second door 198 slides within a track or pocket of the second lateral vertical wall 84 to, from, and between the open position 206 and the closed position 204.

In the open position 206, the middle outlet 178*b* is open and access is allowed through the middle outlet 178*b* disposed at the second lateral vertical wall 84. Thus, air flowing through the top air flow path 146*b* toward the top outlet 66*b* and through the bottom air flow path 162*b* toward the bottom outlet 102*b* at the other side 70 of the baffle assembly 46 also flows through the middle outlet 178*b*.

In use, in instances when the food item 18 that the user desires to cook with the oven 10 occupies a significant portion of the cooking chamber 12, the user can place the first door 196 and the second door 198 of the baffle assembly 46 to their respective open positions 202, 206 to allow air to flow through all of the top outlets 66*a*, 66*b*, middle outlets 178*a*, 178*b*, and bottom outlets 102*a*, 102*b* of the baffle assembly 46. The top heating element 160 and the bottom heating element 176 can be set to heat air flowing through the baffle assembly 46 from the cooking chamber 12 to the same or approximately the same temperature. Thus, the entirety of the volume of the cooking chamber 12 achieves approximately the same temperature.

However, in instances where the user desired to cook two food items 18 with the oven 10, with each food item 18 at a different temperature (e.g., one food item 18 at a higher temperature, the other food item 18 at a lower temperature), the user can place the first door 196 and the second door 198 of the baffle assembly 46 in their respective closed positions 200, 204. In addition, the user places the food item 18 desired to be cooked at the higher temperature within the cooking chamber 12 elevationally above the food item 18 desired to be cooked at the lower temperature.

Air from the cooking chamber 12 will thus flow through the top air flow paths 146*a*, 146*b* to be heated by the top heating element 160 and separately through the bottom air flow paths 162*a*, 162*b* to be heated by the bottom heating element 176. The top heating element 160 is set to heat the air flowing through the top air flow paths 146*a*, 146*b* to a temperature that is greater than a temperature at which the bottom heating element 176 is set to heat the air flowing through the bottom air flow paths 162*a*, 162*b*.

Figure 18:
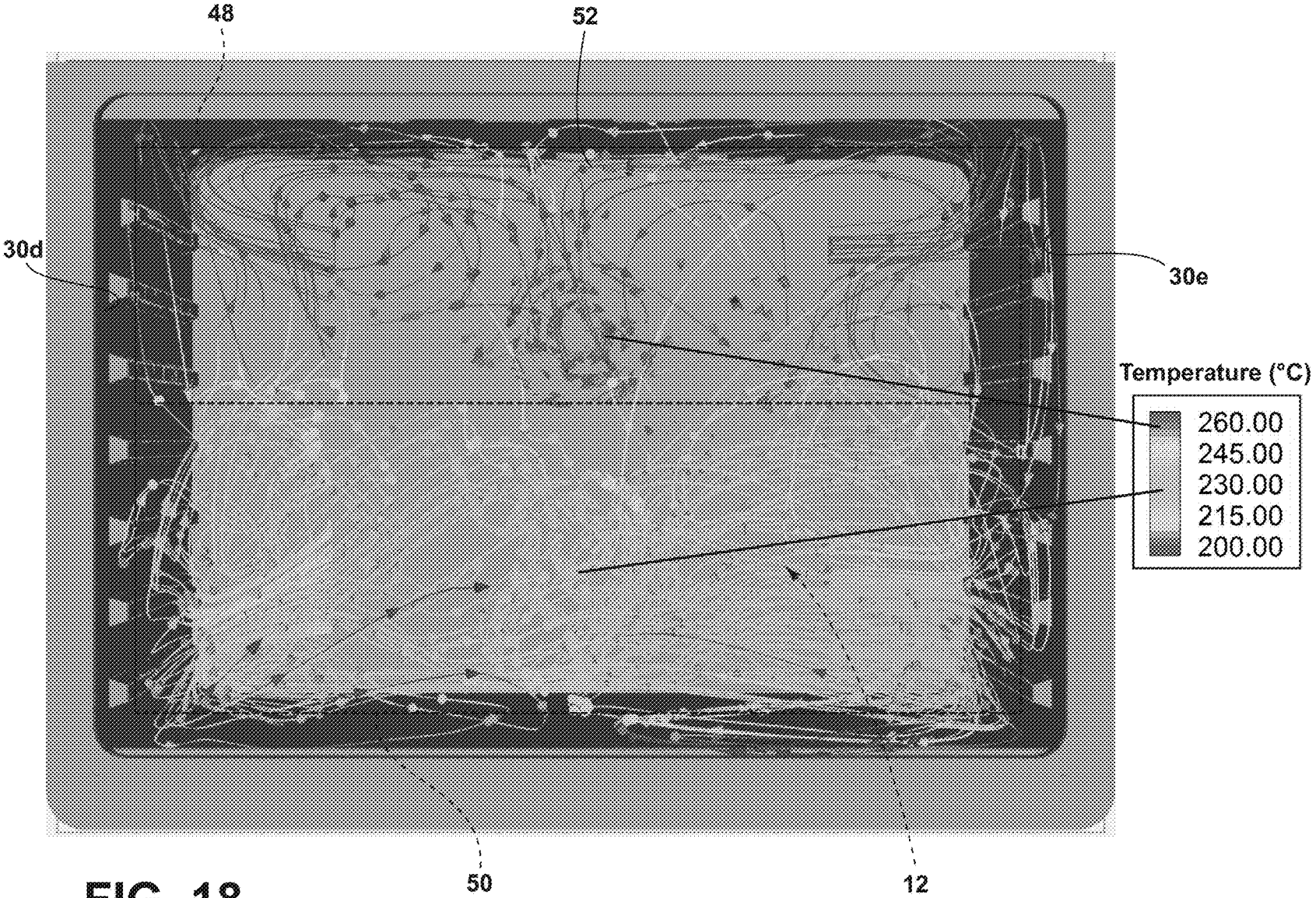
FIG. 18 is an output of a cold flow and heat transfer simulation concerning the baffle assembly of the present disclosure, illustrating that the baffle assembly, the top fan, top heating element, the bottom fan, and the bottom heating element can generate a top region of air flow within the cooking chamber and a bottom region of air flow within the cooking chamber that is distinct from the top region, and the top region having a different temperature than the bottom region.
Figure 19:
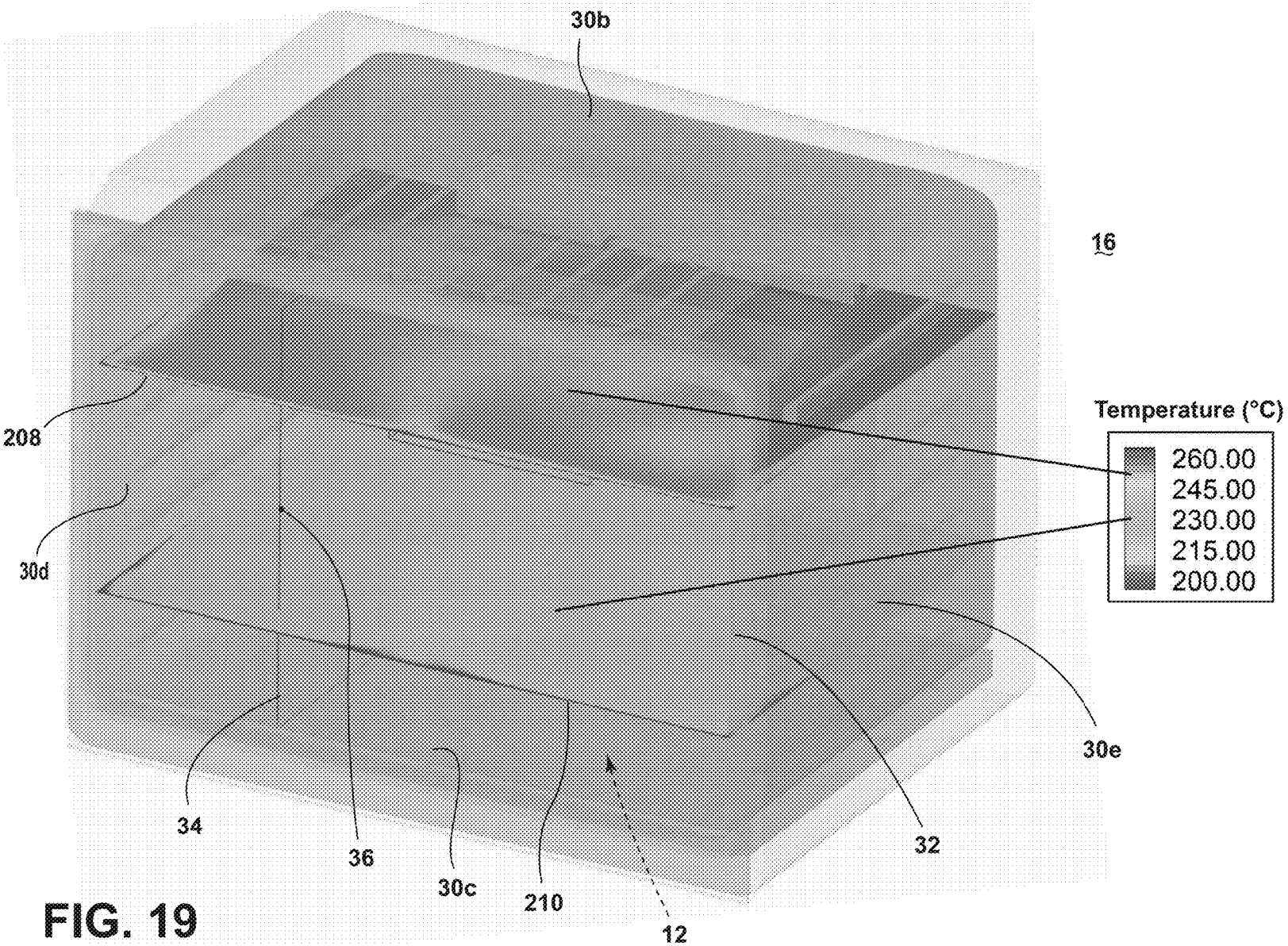
FIG. 19 is another output related to FIG. 18, illustrating a top horizontal plane extending within the top region of air flow having a relatively consistent temperature that is about 30° C. higher than a relatively consistent temperature of a bottom horizontal plane extending within the bottom region of air flow.

Referring now to FIGS. 18 and 19, cold flow and heat transfer simulations have demonstrated that the baffle assembly 46 of the present disclosure, with the first door 196 and the second door 198 in their respective closed positions 200, 204, generates the top region 48 (see FIG. 18) and the bottom region 50 of air flow 52 within the cooking chamber 12. The top region 48 is disposed elevationally above the bottom region 50. The middle wall 144 separating the top air flow paths 146*a*, 146*b* from the bottom air flow paths 162*a*, 162*b* within the baffle assembly 46 helps generate the top region 48 and bottom region 50 of air flow 52 within the cooking chamber 12 (e.g., two distinct regions of air flow 52). The top fan 154 causing air to flow in the top air flow paths 146*a*, 146*b*, and the bottom fan 170 causing air to flow in the bottom air flow paths 162*a*, 162*b* help generate the top region 48 and bottom region 50 of air flow 52 within the cooking chamber 12, as well. The first lateral vertical wall 82 and the second lateral vertical wall 84 elevationally separating the pair of top outlets 66*a*, 66*b* from the pair of bottom outlets 102*a*, 102*b* also help generate two distinct regions of air flow 52 within the cooking chamber 12. The top wall 76 of the baffle assembly 46 providing the tops 78, 80 of the pair of top outlets 66*a*, 66*b*, the forward wall 58 of the baffle assembly 46 providing the forward portions 72, 74 of the pair of top outlets 66*a*, 66*b*, the bottom wall 108 of the baffle assembly 46 providing the bottoms 110, 112 of the pair of bottom outlets 102*a*, 102*b*, and the bottom wall 108 of the baffle assembly 46 providing the forward portions 104, of the pair of bottom outlets 102*a*, 102*b* all also help to generate the top region 48 and bottom region 50 of air flow 52 within the cooking chamber 12, because they all provide a smooth transition from the top air flow paths 146*a*, 146*b* and the bottom air flow paths 162*a*, 162*b* to the cooking chamber 12. The smooth transition helps prevent generation of eddies that could prevent the generation of top region 48 and bottom region 50 of air flow 52 within the cooking chamber 12.

In embodiments, the top region 48 of air flow 52 has a temperature that is at least 20° C. greater than a temperature of the bottom region 50 of air flow 52. For example, air flow 52 within the cooking chamber 12 at a top horizontal plane 208 (see FIG. 19) that is disposed above the midpoint 36 of the average vertical distance 34 has a temperature that is at least 20° C. greater than a temperature of air flow within the cooking chamber 12 at a bottom horizontal plane 210 that is disposed below the midpoint 36 of the average vertical distance 34. The top horizontal plane 208 used to establish the temperature difference can be disposed at 15% to 35% of the average vertical distance 34 from the top wall 30*b* partially defining the cooking chamber 12. The bottom horizontal plane 210 used to establish the temperature difference can be disposed at 65% to 85% of the average vertical distance 34 from the top wall 30*b* partially defining the cooking chamber 12. In embodiments, the temperature difference between the top horizontal plane 208 and the bottom horizontal plane 210 can be 10° C., 11° C., 12° C., 13° C., 14° C., 15° C., 16° C., 17° C., 18° C., 19° C., 20° C., 21° C., 22° C., 23° C., 24° C., 25° C., 26° C., 27° C., 28° C., 29° C., 30° C., 31° C., 32° C., 33° C., 34° C., 35° C., 36° C., 37° C., 38° C., 39° C., 40° C. or greater, or within any range bound by any two of those values (e.g., 13° C. to 28° C., 14° C. to 29° C., and so on). The top heating element 160 and the bottom heating element 176 are operated to achieve and maintain the desired temperatures within each of the top region 48 and the bottom region 50.

Because the baffle assembly 46 is able to generate the top region 48 and the bottom region 50 of air flow 52 having different temperatures, the user can simultaneously cook two food items 18. For example, the user can steam pasta within the top region 48 of the cooking chamber 12 at 100° C. simultaneously with reheating a prior meal within the bottom region 50 of the cooking chamber 12 at 65° C. As another example, the user can cook a rice casserole at 180° C. within the top region 48 of the cooking chamber 12 simultaneously with baking a shortbread cake at 170° C. within the bottom region 50 of the cooking chamber 12. As another example, the user can cook a meat loaf at 230° C. within the top region 48 of the cooking chamber 12 simultaneously with baking potatoes at 200° C. within the bottom region 50 of the cooking chamber 12. Thus, the present disclosure solves the problem of an oven not allowing the user to cook more than one food item 18 simultaneously at different temperatures.

Further, in instances where the user desires to cook a single food item 18 that is sized to fit within solely the top region 48, the baffle assembly 46 of the present disclosure allows the top region 48 to be heated to the desired temperature while the bottom region 50 can be heated to a lower temperature. The first door 196 and the second door 198 of the baffle assembly 46 are placed in their respective closed positions 200, 204. The oven 10 can be preheated so that the top region 48 is at the desired temperature to cook the single food item 18. The lower region, which will not be utilized to cook the single food item 18, can be preheated to a temperature that is less than the temperature of the top region 48. The entirety of the volume of the cooking chamber 12 does not need to be preheated to the temperature at which the single food item 18 will be cooked at the top region 48. The user then places the single food item 18 within the top region 48 for cooking. Thus, the present disclosure solves the problem of a typical oven requiring preheating of the entirety of the volume of the cooking chamber 12 to the desired temperature, and the associated inefficient use of energy and time that arises from doing so.

According to a first aspect of the present disclosure, an oven comprises: (a) interior walls forming a cooking chamber and providing an opening into the cooking chamber; (b) a baffle assembly comprising: (i) a top inlet positioned to draw air from the cooking chamber, (ii) a pair of top outlets, positioned laterally away from the top inlet, with one of the pair of top outlets positioned on one side of the baffle assembly and the other of the pair of top outlets positioned on another side of the baffle assembly, the pair of top outlets positioned to return air to the cooking chamber, (iii) top air flow paths from the top inlet to the pair of top outlets, (iv) a top wall that defines a top of each of the pair of top outlets and a top surface of the top air flow paths, (v) a bottom inlet positioned to draw air from the cooking chamber, (vi) a pair of bottom outlets, positioned laterally away from the bottom inlet, with one of the pair of bottom outlets positioned on the one side of the baffle assembly and the other of the pair of top outlets positioned on the other side of the baffle assembly, the pair of bottom outlets positioned to return air to the cooking chamber, (vii) bottom air flow paths from the bottom inlet to the pair of bottom outlets, and (viii) a bottom wall that defines a bottom of each of the pair of bottom outlets and a bottom surface of the bottom air flow paths; (c) a top fan positioned to force air to flow from the cooking chamber, through the top inlet, through the top air flow paths, and then back into the cooking chamber; (d) a top heating element positioned to heat air flowing through the top air flow paths; (e) a bottom fan positioned to force air to flow from the cooking chamber, through the bottom inlet, through the bottom air flow paths, and then back into the cooking chamber; and (f) a bottom heating element positioned to heat air flowing through the bottom air flow paths.

According to a second aspect of the present disclosure, the oven of the first aspect further comprises a door that is movable to, from, and between (i) a closed position where the door covers the opening into the cooking chamber and (ii) an open position where the door allows access through the opening into the cooking chamber from an external environment.

According to a third aspect of the present disclosure, the oven of any one of the first through second aspects, wherein the top inlet and the pair of top outlets are elevated higher than the bottom inlet and the pair of bottom outlets.

According to a fourth aspect of the present disclosure, the oven of any one of the first through third aspects, wherein (i) the top wall of the baffle assembly is planar, and (ii) the bottom wall of the baffle assembly is planar.

According to a fifth aspect of the present disclosure, the oven of any one of the first through fourth aspects, wherein (i) a top of the top outlet at the one side and a bottom of the bottom outlet at the one side are parallel and (ii) a top of the top outlet at the other side and a bottom of the bottom outlet at the other side are parallel.

According to a sixth aspect of the present disclosure, the oven of any one of the first through fifth aspects, wherein (i) the baffle assembly further comprises a first lateral vertical wall at the one side of the baffle assembly that defines a bottom of the top outlet and a top of the bottom outlet disposed at the one side of the baffle assembly; (ii) the first lateral vertical wall separates the bottom of the top outlet from the top of the bottom outlet at the one side of the baffle assembly; (iii) the baffle assembly further comprises a second lateral vertical wall at the other side of the baffle assembly that defines a bottom of the top outlet and a top of the bottom outlet disposed at the other side of the baffle assembly; and (iv) the second lateral vertical wall separates the bottom of the top outlet from the top of the bottom outlet at the other side of the baffle assembly.

According to a seventh aspect of the present disclosure, the oven of any one of the first through sixth aspects wherein (a) the baffle assembly further comprises a pair of middle outlets, with one of the pair of middle outlets disposed at the one side of the baffle assembly between the top outlet and the bottom outlet that are disposed at the one side of the baffle assembly, and with the other of the pair of middle outlets disposed at the other side of the baffle assembly between the top outlet and the bottom outlet that are disposed at the other side of the baffle assembly; and (b) the baffle assembly further comprises a first door and a second door, (i) the first door is positioned relative to the middle outlet disposed at the one side of the baffle assembly so that, in a closed position, the first door closes the middle outlet, and, in an open position, air can flow from both the top air flow path and the bottom air flow path through the middle outlet disposed at the one side of the baffle assembly, and (ii) the second door is positioned relative to the middle outlet disposed at the other side of the baffle assembly so that, in a closed position, the second door closes the middle outlet, and, in an open position, air can flow from both the top air flow path and the bottom air flow path through the middle outlet disposed at the other side of the baffle assembly.

According to an eighth aspect of the present disclosure, the oven of the seventh aspect, wherein both the first door and the second door are in their respective closed positions when a user cooks two food items, each of the two food items at a different temperature, the food item cooked at the higher temperature disposed elevationally above the food item cooked at the lower temperature.

According to a ninth aspect of the present disclosure, the oven of any one of the first through eighth aspects, wherein the baffle assembly further comprises a middle wall disposed between the top wall and the bottom wall, the middle wall defining (i) a bottom surface of the top air flow paths and (ii) a top surface of the bottom air flow paths.

According to a tenth aspect of the present disclosure, the oven of the ninth aspect, wherein the bottom surface of the top air flow paths and the top surface of the bottom air flow paths are generally horizontal.

According to an eleventh aspect of the present disclosure, the oven of any one of the first through tenth aspects, wherein the top fan spins in a direction that is opposite of a direction in which the bottom fan spins.

According to a twelfth aspect, the oven of any one of the first through eleventh aspects further comprises a top region and a bottom region of air flow within the cooking chamber, the top region disposed elevationally above the bottom region, wherein, the top region of air flow has a temperature that is at least 20° C. greater than a temperature of the bottom region of air flow.

According to a thirteenth aspect of the present disclosure, the oven of any one of the first through twelfth aspects, wherein (i) interior walls defining the cooking chamber comprise a top wall and a bottom wall, the top wall and the bottom wall being separated by an average vertical distance and (ii) air flow within the cooking chamber at a top horizontal plane that is disposed above a midpoint of the average vertical distance comprises a temperature that is at least 20° C. greater than a temperature of air flow within the cooking chamber at a bottom horizontal plane that is disposed below the midpoint of the average vertical distance.

According to a fourteenth aspect of the present disclosure, the oven of the thirteenth aspect, wherein the cooking chamber is free of a solid matter barrier physically dividing the cooking chamber between the top wall and the bottom wall.

According to a fifteenth aspect of the present disclosure, the oven of any one of the first through fourteenth aspects, wherein (a) the interior walls forming the cooking chamber comprise a rear wall that is rearward of the opening into the cooking chamber; (b) the baffle assembly further comprises a forward wall that is forward of the rear wall of the interior walls forming the cooking chamber; (c) the top inlet and the bottom inlet are disposed through the forward wall of the baffle assembly; and (d) the forward wall of the baffle assembly defines (i) a forward portion of each of the pair of top outlets, (ii) a forward surface of the top air flow path, (iii) a forward portion of each of the pair of bottom outlets, and (iv) a forward surface of the bottom air flow path.

According to a sixteenth aspect of the present disclosure, the oven of the fifteenth aspect, wherein (i) the top surface of the top air flow path that the top wall of the baffle assembly defines is generally horizontal; (ii) the bottom surface of the bottom air flow path that the bottom wall of the baffle assembly defines is generally horizontal; and (iii)

the forward surfaces of the top air flow path and the bottom air flow path that the forward wall define are generally vertical.

According to a seventeenth aspect of the present disclosure, the oven of the sixteenth aspect, wherein (a) the baffle assembly further comprises a middle wall that defines (i) a bottom surface of the top air flow paths and (ii) a top surface of the bottom air flow paths; and (b) the bottom surface of the top air flow paths and the top surface of the bottom air flow paths are generally horizontal.

According to an eighteenth aspect of the present disclosure, the oven of any one of the first through seventeenth aspects, wherein (i) the interior walls forming the cooking chamber comprise a rear wall that is rearward of the opening into the cooking chamber; (ii) the baffle assembly further comprises a forward wall that is forward of the rear wall of the interior walls forming the cooking chamber; and (iii) the top fan, the bottom fan, the top heating element, and the bottom heating element are all disposed rearward of the forward wall of the baffle assembly.

According to a nineteenth aspect of the present disclosure, an oven comprises: (I) interior walls forming a cooking chamber and providing an opening into the cooking chamber, the interior walls comprising a rear wall that is disposed rearward of the opening; (II) a baffle assembly attached to the rear wall of the interior walls forming the cooking chamber and projecting forward from the rear wall toward the opening, the baffle assembly comprising: (a) a perimeter flange that is generally planar and that is vertically set flush against the rear wall that partially forms the cooking chamber; (b) a top wall that is generally planar and disposed horizontally; (c) a bottom wall that is generally planar and disposed horizontally; and (d) a middle wall disposed between the top wall and the bottom wall that is generally planar and disposed horizontally; (e) a forward wall that (i) is generally planar and disposed vertically, (ii) is disposed forward of the top wall, the bottom wall, and the middle wall, (iii) coincides with the top wall, the bottom wall, and the middle wall, (iv) comprises a top inlet into the baffle assembly disposed elevationally above the middle wall, and (v) comprises a bottom inlet into the baffle assembly disposed elevationally below the middle wall; (f) a first lateral vertical wall that is generally planar, disposed vertically, disposed forward of the perimeter flange and rearward of the forward wall, the first lateral vertical wall comprising (i) a rear that coincides with the perimeter flange, (ii) a top that coincides with the top wall, (iii) a bottom that coincides with the bottom wall, and (iv) a front that does not coincide with the forward wall except at a top tab and a bottom tab disposed between the top and the bottom that extend forward to coincide with the forward wall, the top tab being disposed elevationally higher than the middle wall, and the bottom tab being disposed elevationally lower than the middle wall; (h) a second lateral vertical wall opposing the first lateral vertical wall that is generally planar, disposed vertically, disposed forward of the perimeter flange and rearward of the forward wall, the second lateral vertical wall comprising (i) a rear that coincides with the perimeter flange, (ii) a top that coincides with the top wall, (ii) a bottom that coincides with the bottom wall, (iii) a front that does not coincide with the forward wall except at a top tab and a bottom tab disposed between the top and the bottom that extend forward to coincide with the forward wall, the top tab being disposed elevationally higher than the middle wall, and the bottom tab being disposed elevationally lower than the middle wall, wherein the top wall, the forward wall, and the first lateral vertical wall cooperate to form a top outlet that is disposed elevationally above the middle wall, with the top wall forming a top of the top outlet, the forward wall forming a forward portion of the top outlet, the first lateral vertical wall forming a rear portion of the top outlet, and the top tab of the first lateral vertical wall forming a bottom of the top outlet; wherein, the forward wall and the first lateral vertical wall cooperate to form a middle outlet that is disposed to overlap elevationally with the middle wall, with the top tab of the first lateral vertical wall forming a top of the middle outlet, the forward wall forming a forward portion of the middle outlet, the first lateral vertical wall forming a rear portion of the middle outlet, and the bottom tab of the first lateral vertical wall forming a bottom of the middle outlet; wherein, the bottom wall, the forward wall, and the first lateral vertical wall cooperate to form a bottom outlet that is disposed elevationally below the middle wall, with the bottom wall forming a bottom of the bottom outlet, the forward wall forming a forward portion of the bottom outlet, the first lateral vertical wall forming a rear portion of the bottom outlet, and the bottom tab of the first lateral vertical wall forming a top of the bottom outlet; wherein, the top wall, the forward wall, and the second lateral vertical wall cooperate to form a top outlet that is disposed elevationally above the middle wall, with the top wall forming a top of the top outlet, the forward wall forming a forward portion of the top outlet, the second lateral vertical wall forming a rear portion of the top outlet, and the top tab of the second lateral vertical wall forming a bottom of the top outlet; wherein, the forward wall and the second lateral vertical wall cooperate to form a middle outlet that is disposed to overlap elevationally with the middle wall, with the top tab of the second lateral vertical wall forming a top of the middle outlet, the forward wall forming a forward portion of the middle outlet, the second lateral vertical wall forming a rear portion of the middle outlet, and the bottom tab of the second lateral vertical wall forming a bottom of the middle outlet; wherein, the top wall, the forward wall, and the second lateral vertical wall cooperate to form a bottom outlet that is disposed elevationally below the middle wall, with the bottom wall forming a bottom of the bottom outlet, the forward wall forming a forward portion of the bottom outlet, the second lateral vertical wall forming a rear portion of the bottom outlet, and the second tab of the second lateral vertical wall forming a top of the bottom outlet; wherein, the top wall, the forward wall, the first lateral vertical wall, the second lateral vertical wall, and the middle wall cooperate to form top air flow paths for air to flow from the cooking chamber, through the top inlet, rearward of the forward wall, out the top outlets at the first lateral vertical wall and the second lateral vertical wall, and back into the cooking chamber; and wherein, the bottom wall, the forward wall, the first lateral vertical wall, the second lateral vertical wall, and the middle wall cooperate to form bottom air flow paths for air to flow from the cooking chamber, through the bottom inlet, rearward of the forward wall, out the bottom outlets at the first lateral vertical wall and the second lateral vertical wall, and back into the cooking chamber.

According to a twentieth aspect of the present disclosure, the oven of the nineteenth aspect, wherein the baffle assembly further comprises: (a) a first door comprising (i) a closed position that closes the middle outlet disposed at the first lateral vertical wall and (ii) an open position that allows access through the middle outlet disposed at the first lateral vertical wall; and (b) a second door comprising (i) a closed position that closes the middle outlet disposed at the second lateral vertical wall and (ii) an open position that allows access through the middle outlet disposed at the second lateral vertical wall.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature, unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven comprising:

interior walls forming a cooking chamber and providing an opening into the cooking chamber, the interior walls comprising a top wall and a bottom wall, the top wall and the bottom wall being separated by an average vertical distance;

a baffle assembly comprising:

a top inlet positioned to draw air from the cooking chamber, a pair of top outlets, positioned laterally away from the top inlet, with one of the pair of top outlets positioned on one side of the baffle assembly and the other of the pair of top outlets positioned on another side of the baffle assembly, the pair of top outlets positioned to return air to the cooking chamber, top air flow paths from the top inlet to the pair of top outlets, a top wall that defines a top of each of the pair of top outlets and a top surface of the top air flow paths, a bottom inlet positioned to draw air from the cooking chamber, a pair of bottom outlets, positioned laterally away from the bottom inlet, with one of the pair of bottom outlets positioned on the one side of the baffle assembly and the other of the pair of bottom outlets positioned on the other side of the baffle assembly, the pair of bottom outlets positioned to return air to the cooking chamber, bottom air flow paths from the bottom inlet to the pair of bottom outlets, a bottom wall that defines a bottom of each of the pair of bottom outlets and a bottom surface of the bottom air flow paths, a middle wall disposed between the top wall and the bottom wall, the middle wall defining (i) a bottom surface of the top air flow paths and (ii) a top surface of the bottom air flow paths, a first lateral wall at the one side of the baffle assembly that defines a bottom of the top outlet and a top of the bottom outlet disposed at the one side of the baffle assembly, the first lateral wall separating the bottom of the top outlet from the top of the bottom outlet at the one side of the baffle assembly, a second lateral wall at the other side of the baffle assembly that defines a bottom of the top outlet and a top of the bottom outlet disposed at the other side of the baffle assembly, the second lateral wall separating the bottom of the top outlet from the top of the bottom outlet at the other side of the baffle assembly;

a top fan positioned to force air to flow from the cooking chamber, through the top inlet, through the top air flow paths, and then back into the cooking chamber;

a top heating element positioned to heat air flowing through the top air flow paths;

a bottom fan positioned to force air to flow from the cooking chamber, through the bottom inlet, through the bottom air flow paths, and then back into the cooking chamber; and a bottom heating element positioned to heat air flowing through the bottom air flow paths, wherein, during use of the oven and while the cooking chamber is free of a solid matter barrier physically dividing the cooking chamber between the top wall and the bottom wall, the oven is configured to generate air flow within the cooking chamber at a top horizontal plane that is disposed above a midpoint of the average vertical distance having a temperature that is at least 20° C. greater than a temperature of air flow within the cooking chamber at a bottom horizontal plane that is disposed below the midpoint of the average vertical distance.

2. The oven of claim 1 further comprising:

a door that is movable to, from, and between (i) a closed position where the door covers the opening into the cooking chamber and (ii) an open position where the door allows access through the opening into the cooking chamber from an external environment.

3. The oven of claim 1, wherein the top inlet and the pair of top outlets are elevated higher than the bottom inlet and the pair of bottom outlets.

4. The oven of claim 1, wherein the top wall of the baffle assembly is planar; and the bottom wall of the baffle assembly is planar.

5. The oven of claim 1, wherein a top of the top outlet at the one side and a bottom of the bottom outlet at the one side are parallel; and a top of the top outlet at the other side and a bottom of the bottom outlet at the other side are parallel.

6. The oven of claim 1, wherein the bottom surface of the top air flow paths and the top surface of the bottom air flow paths are generally horizontal.

7. The oven of claim 1, wherein the top fan spins in a direction that is opposite of a direction in which the bottom fan spins.

8. The oven of claim 1 further comprising:

a top region and a bottom region of air flow within the cooking chamber, the top region disposed elevationally above the bottom region;

wherein, the top region of air flow has a temperature that is at least 20° C. greater than a temperature of the bottom region of air flow.

9. The oven of claim 1, wherein the first lateral wall is vertical and the second lateral wall is vertical;

the interior walls forming the cooking chamber comprise a rear wall that is rearward of the opening into the cooking chamber;

the baffle assembly further comprises a forward wall that is forward of the rear wall of the interior walls forming the cooking chamber;

the top inlet and the bottom inlet are disposed through the forward wall of the baffle assembly; and the forward wall of the baffle assembly defines (i) a forward portion of each of the pair of top outlets, (ii) a forward surface of the top air flow path, (iii) a forward portion of each of the pair of bottom outlets, and (iv) a forward surface of the bottom air flow path.

10. The oven of claim 9, wherein the top surface of the top air flow path that the top wall of the baffle assembly defines is generally horizontal;

the bottom surface of the bottom air flow path that the bottom wall of the baffle assembly defines is generally horizontal; and the forward surfaces of the top air flow path and the bottom air flow path that the forward wall define are generally vertical.

11. The oven of claim 10, wherein the bottom surface of the top air flow paths and the top surface of the bottom air flow paths are generally horizontal.

12. The oven of claim 1, wherein the interior walls forming the cooking chamber comprise a rear wall that is rearward of the opening into the cooking chamber;

the baffle assembly further comprises a forward wall that is forward of the rear wall of the interior walls forming the cooking chamber; and the top fan, the bottom fan, the top heating element, and the bottom heating element are all disposed rearward of the forward wall of the baffle assembly.

13. An oven comprising:

interior walls forming a cooking chamber and providing an opening into the cooking chamber, the interior walls comprising a rear wall that is disposed rearward of the opening;

a baffle assembly attached to the rear wall of the interior walls forming the cooking chamber and projecting forward from the rear wall toward the opening, the baffle assembly comprising:

a perimeter flange that is generally planar and that is vertically set flush against the rear wall that partially forms the cooking chamber, a top wall that is generally planar and disposed horizontally, a bottom wall that is generally planar and disposed horizontally, a middle wall disposed between the top wall and the bottom wall that is generally planar and disposed horizontally, a forward wall that (i) is generally planar and disposed vertically, (ii) is disposed forward of the top wall, the bottom wall, and the middle wall, (iii) coincides with the top wall, the bottom wall, and the middle wall, (iv) comprises a top inlet into the baffle assembly disposed elevationally above the middle wall, and (v) comprises a bottom inlet into the baffle assembly disposed elevationally below the middle wall, a first lateral vertical wall that is generally planar, disposed vertically, disposed forward of the perimeter flange and rearward of the forward wall, the first lateral vertical wall comprising (i) a rear that coincides with the perimeter flange, (ii) a top that coincides with the top wall, (iii) a bottom that coincides with the bottom wall, and (iv) a front that does not coincide with the forward wall except at a top tab and a bottom tab disposed between the top and the bottom that extend forward to coincide with the forward wall, the top tab being disposed elevationally higher than the middle wall, and the bottom tab being disposed elevationally lower than the middle wall, and a second lateral vertical wall opposing the first lateral vertical wall that is generally planar, disposed vertically, disposed forward of the perimeter flange and rearward of the forward wall, the second lateral vertical wall comprising (i) a rear that coincides with the perimeter flange, (ii) a top that coincides with the top wall, (iii) a bottom that coincides with the bottom wall, and (iv) a front that does not coincide with the forward wall except at another top tab and another bottom tab, disposed between the top and the bottom that extend forward to coincide with the forward wall, the another top tab being disposed elevationally higher than the middle wall, and the another bottom tab being disposed elevationally lower than the middle wall;

wherein, the top wall, the forward wall, and the first lateral vertical wall cooperate to form a top outlet that is disposed elevationally above the middle wall, with the top wall forming a top of the top outlet, the forward wall forming a forward portion of the top outlet, the first lateral vertical wall forming a rear portion of the top outlet, and the top tab of the first lateral vertical wall forming a bottom of the top outlet;

wherein, the forward wall and the first lateral vertical wall cooperate to form a middle outlet that is disposed to overlap elevationally with the middle wall, with the top tab of the first lateral vertical wall forming a top of the middle outlet, the forward wall forming a forward portion of the middle outlet, the first lateral vertical wall forming a rear portion of the middle outlet, and the bottom tab of the first lateral vertical wall forming a bottom of the middle outlet;

wherein, the bottom wall, the forward wall, and the first lateral vertical wall cooperate to form a bottom outlet that is disposed elevationally below the middle wall, with the bottom wall forming a bottom of the bottom outlet, the forward wall forming a forward portion of the bottom outlet, the first lateral vertical wall forming a rear portion of the bottom outlet, and the bottom tab of the first lateral vertical wall forming a top of the bottom outlet;

wherein, the top wall, the forward wall, and the second lateral vertical wall cooperate to form a top outlet that is disposed elevationally above the middle wall, with the top wall forming a top of the top outlet, the forward wall forming a forward portion of the top outlet, the second lateral vertical wall forming a rear portion of the top outlet, and the top tab of the second lateral vertical wall forming a bottom of the top outlet;

wherein, the forward wall and the second lateral vertical wall cooperate to form a middle outlet that is disposed to overlap elevationally with the middle wall, with the top tab of the second lateral vertical wall forming a top of the middle outlet, the forward wall forming a forward portion of the middle outlet, the second lateral vertical wall forming a rear portion of the middle outlet, and the bottom tab of the second lateral vertical wall forming a bottom of the middle outlet;

wherein, the top wall, the forward wall, and the second lateral vertical wall cooperate to form a bottom outlet that is disposed elevationally below the middle wall, with the bottom wall forming a bottom of the bottom outlet, the forward wall forming a forward portion of the bottom outlet, the second lateral vertical wall forming a rear portion of the bottom outlet, and the bottom tab of the second lateral vertical wall forming a top of the bottom outlet;

wherein, the top wall, the forward wall, the first lateral vertical wall, the second lateral vertical wall, and the middle wall cooperate to form top air flow paths for air to flow from the cooking chamber, through the top inlet, rearward of the forward wall, out the top outlets at the first lateral vertical wall and the second lateral vertical wall, and back into the cooking chamber; and wherein, the bottom wall, the forward wall, the first lateral vertical wall, the second lateral vertical wall, and the middle wall cooperate to form bottom air flow paths for air to flow from the cooking chamber, through the bottom inlet, rearward of the forward wall, out the bottom outlets at the first lateral vertical wall and the second lateral vertical wall, and back into the cooking chamber.

14. The oven of claim 13, wherein the baffle assembly further comprises:

a first door comprising (i) a closed position that closes the middle outlet disposed at the first lateral vertical wall and (ii) an open position that allows access through the middle outlet disposed at the first lateral vertical wall, and a second door comprising (i) a closed position that closes the middle outlet disposed at the second lateral vertical wall and (ii) an open position that allows access through the middle outlet disposed at the second lateral vertical wall.

15. An oven comprising:

interior walls forming a cooking chamber and providing an opening into the cooking chamber;

a baffle assembly comprising:

a top inlet positioned to draw air from the cooking chamber, a pair of top outlets, positioned laterally away from the top inlet, with one of the pair of top outlets positioned on one side of the baffle assembly and the other of the pair of top outlets positioned on another side of the baffle assembly, the pair of top outlets positioned to return air to the cooking chamber, top air flow paths from the top inlet to the pair of top outlets, a top wall that defines a top of each of the pair of top outlets and a top surface of the top air flow paths, a bottom inlet positioned to draw air from the cooking chamber, a pair of bottom outlets, positioned laterally away from the bottom inlet, with one of the pair of bottom outlets positioned on the one side of the baffle assembly and the other of the pair of bottom outlets positioned on the other side of the baffle assembly, the pair of bottom outlets positioned to return air to the cooking chamber, bottom air flow paths from the bottom inlet to the pair of bottom outlets, a bottom wall that defines a bottom of each of the pair of bottom outlets and a bottom surface of the bottom air flow paths, a pair of middle outlets, one of the pair of middle outlets disposed at the one side of the baffle assembly between the top outlet and the bottom outlet that are disposed at the one side of the baffle assembly, and the other of the pair of middle outlets disposed at the other side of the baffle assembly between the top outlet and the bottom outlet that are disposed at the other side of the baffle assembly, and a first door and a second door, the first door is positioned relative to the middle outlet disposed at the one side of the baffle assembly so that, in a closed position, the first door closes the middle outlet, and, in an open position, air can flow from both the top air flow path and the bottom air flow path through the middle outlet disposed at the one side of the baffle assembly, and the second door is positioned relative to the middle outlet disposed at the other side of the baffle assembly so that, in a closed position, the second door closes the middle outlet, and, in an open position, air can flow from both the top air flow path and the bottom air flow path through the middle outlet disposed at the other side of the baffle assembly;

a top fan positioned to force air to flow from the cooking chamber, through the top inlet, through the top air flow paths, and then back into the cooking chamber;

a top heating element positioned to heat air flowing through the top air flow paths;

a bottom fan positioned to force air to flow from the cooking chamber, through the bottom inlet, through the bottom air flow paths, and then back into the cooking chamber; and a bottom heating element positioned to heat air flowing through the bottom air flow paths.

16. The oven of claim 15, wherein both the first door and the second door are in their respective closed positions when a user cooks two food items, each of the two food items at a different temperature, with the food item cooked at the higher temperature disposed elevationally above the food item cooked at the lower temperature.

17. The oven of claim 15, wherein the interior walls comprise a top wall and a bottom wall, the top wall and the bottom wall being separated by an average vertical distance, and air flow within the cooking chamber at a top horizontal plane that is disposed above a midpoint of the average vertical distance comprises a temperature that is at least 20° C. greater than a temperature of air flow within the cooking chamber at a bottom horizontal plane that is disposed below the midpoint of the average vertical distance.

18. The oven of claim 17, wherein the cooking chamber is free of a solid matter barrier physically dividing the cooking chamber between the top wall and the bottom wall.

19. The oven of claim 15, wherein the baffle assembly further comprises a first lateral vertical wall at the one side of the baffle assembly that defines a bottom of the top outlet and a top of the bottom outlet disposed at the one side of the baffle assembly;

the first lateral vertical wall separates the bottom of the top outlet from the top of the bottom outlet at the one side of the baffle assembly;

the baffle assembly further comprises a second lateral vertical wall at the other side of the baffle assembly that defines a bottom of the top outlet and a top of the bottom outlet disposed at the other side of the baffle assembly; and the second lateral vertical wall separates the bottom of the top outlet from the top of the bottom outlet at the other side of the baffle assembly.

20. The oven of claim 15, wherein the baffle assembly further comprises a middle wall disposed between the top wall and the bottom wall, the middle wall defining (i) a bottom surface of the top air flow paths and (ii) a top surface of the bottom air flow paths.

* * * * *